US008323726B2

(12) United States Patent
Naka et al.

(10) Patent No.: US 8,323,726 B2
(45) Date of Patent: Dec. 4, 2012

(54) PRODUCTION METHOD OF MAGNETIC CARRIER AND MAGNETIC CARRIER PRODUCED THEREWITH

(75) Inventors: Takeshi Naka, Susono (JP); Yoshinobu Baba, Yokohama (JP); Koh Ishigami, Mishima (JP); Yoshiaki Shiotari, Mishima (JP); Kentaro Kamae, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 66 days.

(21) Appl. No.: 12/899,957

(22) Filed: Oct. 7, 2010

(65) Prior Publication Data

US 2011/0024669 A1 Feb. 3, 2011

Related U.S. Application Data

(63) Continuation of application No. PCT/JP2010/003894, filed on Jun. 11, 2010.

(30) Foreign Application Priority Data

Jun. 19, 2009 (JP) ..... 2009-146230
Jun. 19, 2009 (JP) ..... 2009-146235

(51) Int. Cl.
*B05D 5/12* (2006.01)

(52) U.S. Cl. ..... 427/127

(58) Field of Classification Search ..... 427/128, 427/127

See application file for complete search history.

(56) References Cited

U.S. PATENT DOCUMENTS 5,350,656 A 9/1994 Kouno et al.
2010/0279224 A1 * 11/2010 Okamoto et al. ..... 430/111.1

FOREIGN PATENT DOCUMENTS

| | | | |
|---|---|---|---|
| JP | 63-235959 | A | 9/1988 |
| JP | 03-269547 | A | 12/1991 |
| JP | 10-048891 | A | 2/1998 |
| JP | 10-282727 | A | 10/1998 |
| JP | 2811079 | B2 | 10/1998 |
| JP | 2005-270955 | A | 10/2005 |
| JP | 2009-160307 | A | 7/2009 |
| WO | WO/2009/081999 | * | 2/2007 |

OTHER PUBLICATIONS

English translation of International Preliminary Report on Patentability, International Application No. PCT/JP2010/003894, Mailing Date Jan. 26, 2012.

* cited by examiner

*Primary Examiner* — Michael Cleveland
*Assistant Examiner* — Tabassom Tadayyon Eslami
(74) *Attorney, Agent, or Firm* — Fitzpatrick, Cella, Harper & Scinto

(57) ABSTRACT

When a surface of magnetic carrier core particles is coated with coating resin composition particles, the coating is conducted so that a surface of the magnetic carrier is free from cracks and chips and has fewer residual resin composition particles and a coating is uniform. In the method, a rotor having a plurality of stirring members on a surface thereof is rotated to coat the surface of magnetic carrier core particles with the resin composition particles. When the coating is conducted, while repeatedly conducting transportation in a direction of a driver and transportation in an anti-driver direction, the surface of the magnetic carrier core particles is coated with the resin composition. The resin composition particles has a 50% particle diameter (D50) based on volume of 0.2 μm or more to 6.0 μm or less and the proportion of particles of 10.0 μm or more is 2.0% by volume or less.

3 Claims, 5 Drawing Sheets

PRODUCTION METHOD OF MAGNETIC CARRIER AND MAGNETIC CARRIER PRODUCED THEREWITH

CROSS-REFERENCE TO RELATED APPLICATIONS

This application is a continuation of International Application No. PCT/JP2010/003894, filed on Jun. 11, 2010, which claims the benefit of Japanese Patent Application Nos. 2009-146230, filed on Jun. 19, 2009, and 2009-146235, filed on Jun. 19, 2009.

BACKGROUND OF THE INVENTION

1. Field of the Invention

The present invention relates to a production method for a magnetic carrier that is used in a development method where an electrostatic latent image formed on an electrostatic latent image bearing member is developed with a two-component type developer to form a toner image on the electrostatic latent image bearing member.

2. Description of the Related Art

Recently, a two-component type developer used in electrophotography has been required to be higher in image quality and stability in its performance from the viewpoint of satisfying market needs such as accelerated color shift in office use, higher definition corresponding to a graphic market and higher speed corresponding to light printing.

At present time, as a magnetic carrier constituting a two-component type developer, a magnetic carrier where a surface of ferrite core particles or magnetic material-dispersed resin core particles (hereinafter, referred to as magnetic carrier core particles) is formed from a coated layer of a resin composition is mainly used.

The coated layer plays the role of controlling charge injection from a developer bearing member via the magnetic carrier to a photosensitive member to stabilize a charge amount distribution of toner and to improve endurance capable of stably imparting charges also for use in a long period of time.

So far, as a method of coating a surface of the magnetic carrier core particles with a resin composition, a so-called wet coating process has been mainly used.

As a wet coating process, a process where a surface of magnetic carrier core particles floating in a fluid layer is spray-coated with a coating solution obtained by dissolving a resin composition in a solvent, or a process where magnetic carrier core particles are dipped in a coating solution where the resin composition is dissolved in a solvent can be cited.

The wet coating process is effective from the viewpoint of uniformly coating a surface of magnetic carrier core particles with a resin composition. However, a problem of the wet coating process is that when a solvent vaporizes magnetic carriers tend to coalesce.

Even when coalesced magnetic carrier is disintegrated by stirring, a surface of the magnetic carrier core particles is exposed on the disintegrated surface thereof to tend to cause a so-called charge injection phenomenon that is an injection phenomenon of charges from the magnetic carrier to a photosensitive member.

When the charge injection phenomenon occurs, a surface potential of a photosensitive member converges on a development bias to be unable to secure a development contrast to result in occurrence of, in some cases, a blank image.

Furthermore, when a surface of the magnetic carrier core particles is exposed, in particular under high temperature and high humidity, toner charges cannot be retained and thereby, owing to low toner charge after leaving for a long period of time, image defects such as fogging tend to occur.

Still furthermore, in order to completely remove a solvent, a drying step is separately necessary to cause a factor of tact-up; accordingly, the wet coating process yet has many improvement points also from the production point of view.

In this connection, as a process that overcomes the problem of the wet coating process, a process that conducts a dry coating by heat has been proposed.

For example, Japanese Patent Application Laid-Open No. 2009-160307 discloses a process where a powdery material to be processed is, under mixing and stirring with a stirring blade by use of a high-speed stirring mixer, thermally coated at a temperature higher than the glass transition temperature (Tg) of resin composition particles contained in the material to be processed or more to obtain a magnetic carrier.

According to the process, a heat medium is flowed to a jacket disposed inside of a body casing to heat an entire apparatus to raise a temperature of the entire material to be processed to the glass transition temperature (Tg) or more of resin composition particles contained in the material to be processed.

The above-mentioned process is advantageous from the viewpoint that there is no need of separately disposing a drying step. However, since a temperature of an entire material to be processed is raised to the glass transition temperature (Tg) of the resin composition particles contained in the material to be processed or more, the magnetic carrier tends to unify; accordingly, there is still room for improvement in uniform coating.

On the other hand, a process where dry coating is conducted by a mechanical impact force has been proposed.

For example, Japanese Patent Application Laid-Open No. S63-235959 proposes a process where a surface modifying apparatus having a rotor and a stator is used to coat a surface of magnetic carrier core particles with resin composition particles having a particle diameter of one tenth or less the magnetic carrier core particles.

According to the above-mentioned process, by the use of a separate apparatus from an apparatus for coating, the resin composition particles are dispersed on a surface of the magnetic carrier core particles; accordingly, there is an inconvenience in that a dispersion apparatus is separately necessary.

When the dispersion apparatus is not used, the resin composition particles remain isolated to result in difficulty in well coating a surface of the magnetic carrier core particles with the resin composition particles.

Furthermore, even when the resin composition particles are attached onto a surface of the magnetic carrier core particles by the use of an apparatus separate from an apparatus for coating, in the case where the resin composition particles are much added, non-attached resin composition particles remain isolated; accordingly, uniform coating is difficult. Still furthermore, since a coated layer in a formulated amount is not formed, variation in charge-imparting property is caused between magnetic carrier particles or lots. Hereinafter, the resin composition particles that could not be attached are referred to as residual resin composition particles.

Accordingly, a coating amount of the resin composition particles is limited by the method, and, thereby, in some cases, toner charge amount control or charge injection control from a magnetic carrier to a photosensitive member become difficult.

On the other hand, in order to increase a coating amount of resin composition particles, in Japanese Patent No. 2811079, a process where, by the use of a high-speed stirring mixer, the resin composition particles are intermittently supplied by dividing into at least two times has been disclosed.

However, also in the process, the residual resin composition particles that were not used for coating are generated, every time when magnetic carriers are produced, performance such as a charging property or specific resistance of the magnetic carrier fluctuates between magnetic carriers; accordingly, in some cases, a magnetic carrier stable over a long period of time cannot be obtained.

Furthermore, as a separate composite coating apparatus that uses a mechanical impact force, in Japanese Patent Application Laid-Open No. 2005-270955, a coating apparatus has been proposed.

It is said that the coating apparatus, while taking an advantage of a rotary blade apparatus, applies an unprecedentedly strong force to a material to be processed such as a powder or the like to heighten a stirring effect, and, thereby, various processings such as compositing, surface modification and the like of a material to be processed such as powder and the like can be conducted.

However, depending on properties of particles used as resin composition particles, there is a problem that residual resin composition particles are generated. Furthermore, in order to obtain a magnetic carrier where the occurrence of cracks or chips on a surface of a magnetic carrier is suppressed, a coating amount of the resin composition particles is much and uniform coating is conducted, there still remains room for improvement. In particular, there is much room for improvement in uniformity of the magnetic carrier surface.

SUMMARY OF THE INVENTION

An object of the present invention is to provide a production method in which the surface of magnetic carrier core particles is coated with resin composition particles by a dry process, and when the coating process is conducted, generation of cracks or chips on a magnetic carrier surface is suppressed, residual resin composition particles can be reduced and uniform coating is conducted.

Furthermore, another object of the present invention is to obtain a magnetic carrier excellent in the stability with time, which can suppress a decrease in toner charge amount after leaving even under high temperature and high humidity, by reducing residual resin composition particles to stabilize a formulation.

The problems can be overcome by features of the present invention described below.

The present invention is a method for producing a magnetic carrier, in which a surface of magnetic carrier core particles is coated with resin composition particles by a mechanical impact force to produce a magnetic carrier coated with a resin composition, and the production method is characterized in that the coating is conducted by the use of a coating apparatus having a rotor having at least a plurality of stirring members on a surface thereof, a driver for driving the rotor by rotation, and a body casing disposed with a gap from the stirring members, the resin composition particles has a 50% particle diameter (D50) based on volume of from 0.2 μm or more to 6.0 μm or less and the proportion of particles of 10.0 μm or more is 2.0% by volume or less, and the magnetic carrier core particles and the resin composition particles input in the coating apparatus are, by rotating the rotor, transported by a part of the stirring members in a driver direction which is one direction of an axial direction of the rotor and transported by another other part of the stirring members in an anti-driver direction which is a direction opposite to the axial direction of the rotor, followed by, while repeatedly conducting the transportation in the driver direction and transportation in the anti-driver direction, coating the surface of the magnetic carrier core particles with the resin composition particles.

According to the present invention, there is provided a production method which can suppress the occurrence of cracks or chips on the surface of magnetic carrier, can reduce residual resin composition particles and can produce a magnetic carrier having a uniform coating.

Furthermore, according to the present invention, a magnetic carrier can be obtained which is excellent in the stability with time, which can suppress decrease in a charge amount of toner after leaving under high temperature and high humidity from decreasing, by reducing residual resin composition particles can be obtained.

Further features of the present invention will become apparent from the following description of exemplary embodiments with reference to the attached drawings.

DESCRIPTION OF THE EMBODIMENTS

Figure 1:
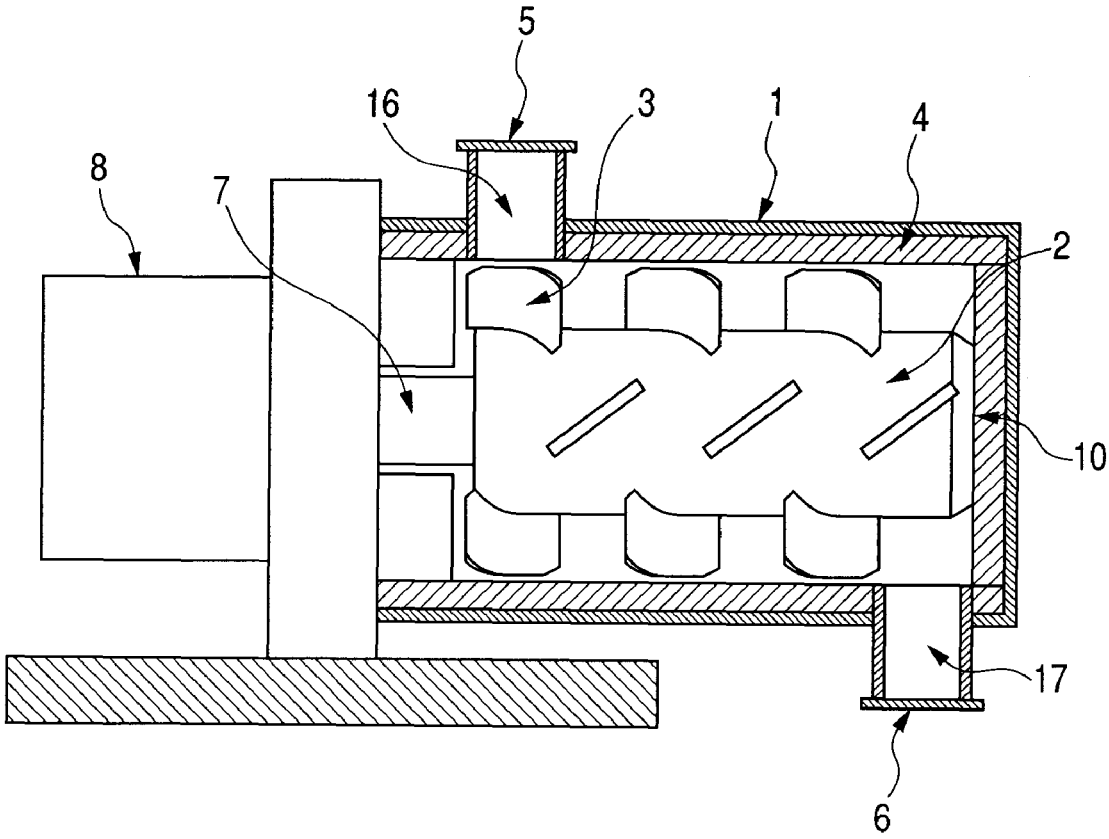
FIG. 1 is a schematic diagram illustrating an example of a coating apparatus that can be used in a method for producing a magnetic carrier of the present invention.

In what follows, embodiments for carrying out the present invention will be described in detail.

A method of producing a magnetic carrier according to the present invention has a coating step where by the use of a coating apparatus having a device for coating by a mechanical impact force, a surface of magnetic carrier core particles is coated with resin composition particles.

Firstly, a coating apparatus used in a step of coating a magnetic carrier of the present invention will be described with reference to FIGS. 1 to 5. The description will be given along the drawings without restricting the invention to a configuration illustrated in the drawings.

The coating apparatus has, as illustrated in FIG. 1, a rotor 2 on a surface of which at least a plurality of stirring members 3 are disposed, a driver 8 for driving the rotor 2 by rotation, and a body casing 1 disposed with a gap with the stirring members 3.

In a method for producing a magnetic carrier according to the present invention, the coating apparatus is used and the rotor 2 is rotated by the driver 8 and the magnetic carrier core particles and the resin composition particles input in the coating apparatus are stirred and mixed by the stirring members 3, whereby a surface of the magnetic carrier core particles is coated with the resin composition particles. The magnetic carrier core particles and the resin composition particles are hereinafter referred to as a material to be processed.

Figure 3:
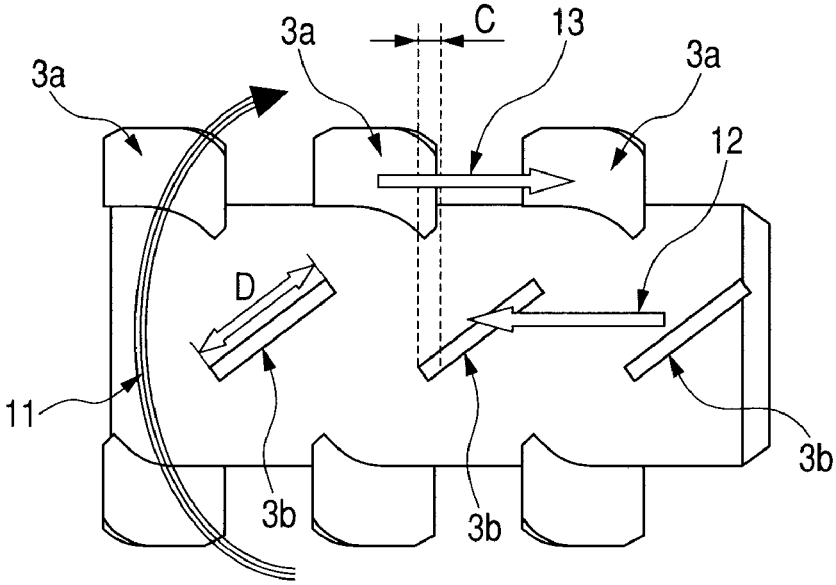
FIG. 3 is a schematic diagram illustrating an example of a stirring member used in a coating apparatus which can be used in a method for producing a magnetic carrier of the present invention.

Furthermore, according to the present invention, in FIG. 3, magnetic carrier core particles and resin composition particles input in the coating apparatus are transported by a part of the stirring members in a driver direction (12) which is one direction of an axial direction of the rotor and transported by another other part of the stirring members in an anti-driver direction (13) which is a direction opposite to the driver direction. And, while repeating the transportation in a driver direction (12) and the transportation in an anti-driver direction (13), a surface of the magnetic carrier core particles is coated with resin composition particles to produce a magnetic carrier in which a surface of magnetic carrier core particles is coated with a resin composition.

Furthermore, an apparatus illustrated in FIG. 1 has a jacket 4 capable of causing a cooling medium to flow to an inner surface side of a body casing 1 and to a rotor end side surface 10. At an upper portion of the body casing 1, a raw material inlet 5 for introducing magnetic carrier core particles and resin composition particles is disposed. At a lower portion of the body casing 1, a magnetic carrier outlet 6 for outputting a coated magnetic carrier outside of the body casing 1 is disposed. Furthermore, inside of the raw material inlet 5, an inner piece 16 for use in a raw material inlet which is a sealing member of the raw material inlet is inserted, and, inside of the magnetic carrier outlet 6, an inner piece 17 for use in a magnetic carrier outlet which is a sealing member of the magnetic carrier outlet is inserted.

Figure 4:
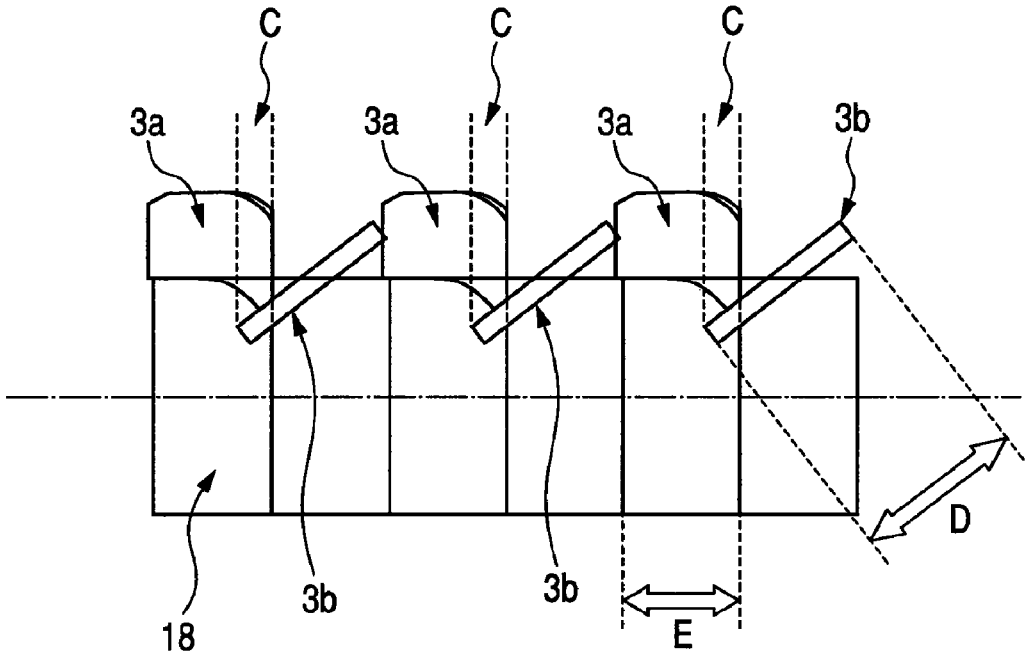
FIG. 4 is a schematic diagram illustrating a configuration of stirring members used in a coating apparatus that can be used in a method for producing a magnetic carrier of the present invention.
Figure 5:
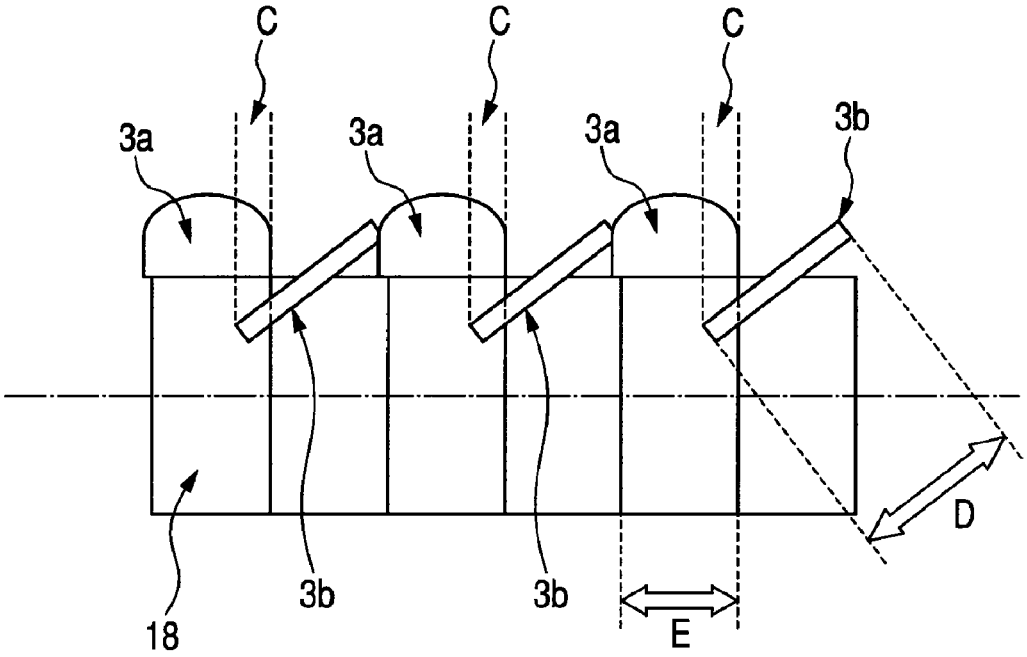
FIG. 5 is a schematic diagram illustrating a configuration of other stirring members used in a coating apparatus that can be used in a method for producing a magnetic carrier of the present invention.

Still furthermore, the rotor 2 illustrated in FIG. 1 forms, as illustrated in FIGS. 4 and 5, one rotor by superposing a plurality of rotors 18.

In the present invention, firstly, the inner piece 16 for use in a raw material inlet is taken out of the raw material inlet 5, and magnetic carrier core particles are poured in from the raw material inlet 5. Then, resin composition particles are poured in from the raw material inlet 5 and the inner piece 16 for use in a raw material inlet is inserted.

In the next place, by the driver 8, the rotor 2 having a plurality of the stirring members 3 on a surface thereof is rotated to stir and mix the material to be processed thus poured in the above to coat a surface of magnetic carrier core particles with resin composition particles.

As to an inputting order, firstly resin composition particles may be input from the raw material inlet 5, then, magnetic carrier core particles may be input from the raw material inlet 5. Alternatively, after magnetic carrier core particles and resin composition particles are previously mixed by a mixer such as Henschel Mixer, the resulting mixture may be input from the raw material inlet 5 of the apparatus illustrated in FIG. 1.

After the completion of the coating, the inner piece 17 for use in a magnetic carrier outlet inside of the magnetic carrier outlet 6 is taken out and the rotor 2 is rotated by the driver 8 to output a magnetic carrier from the magnetic carrier outlet 6. The resulting magnetic carrier is subjected to magnetic concentration and, as required, coarse particles are separated by the use of a sieving machine such as a circular vibration sifter to obtain a magnetic carrier.

In the present invention, the coating is conducted batchwise as described above. However, in a state where the inner piece 16 for use in a raw material inlet and the inner piece 17 for use in a magnetic carrier outlet are removed from the beginning, the coating may be conducted by a continuous process.

When the coating is continuously conducted, in a state where the inner piece 16 for use in a raw material inlet and the inner piece 17 for use in a magnetic carrier outlet are removed from the beginning, the rotor 2 is rotated by the driver 8, the material to be processed is input from the raw material inlet 5 and a magnetic carrier which is an end product is recovered from the magnetic carrier outlet 6.

As illustrated in FIG. 3, when the coating is conducted, the rotor 2 rotates in an anti-clockwise direction 11 seen from a direction of the driver 8. At that time, three (3) stirring members **3*b* located at a center of the rotor 2 vertically move relative to a central shaft 7, respectively, to positions of three (3) stirring members 3*a* located at an upper portion of the rotor 2**.

The material to be processed collided with a stirring member **3*a* during rotation is sent from the driver 8 to the anti-driver direction (13) which is a direction of the rotor end side surface 10, and, the material to be processed collided with a stirring member 3*b* is sent from the rotor end side surface 10 to the driver direction (12) which is a direction of the driver 8. That is, owing to rotation of the rotor 2, transportation to the driver direction (12) and transportation to the anti-driver direction (13**) are repeated for processing.

Furthermore, as illustrated in FIG. 4, an arbitrary stirring member **3*a* and a stirring member 3*b* adjacent to a stirring member 3*a* on a downstream side in a rotation direction, when a rotor is rotated, exist at a position where a trajectory of the stirring member 3*a* and a trajectory of the stirring member 3*b* overlap each other. In order to describe a width C in FIG. 4, the stirring member 3*b* is conveniently slid in a direction of the stirring member 3*a* to make the superposition of the stirring member 3*a* and the stirring member 3*b* clear. The situation is the same also in FIG. 5**.

Figure 6:
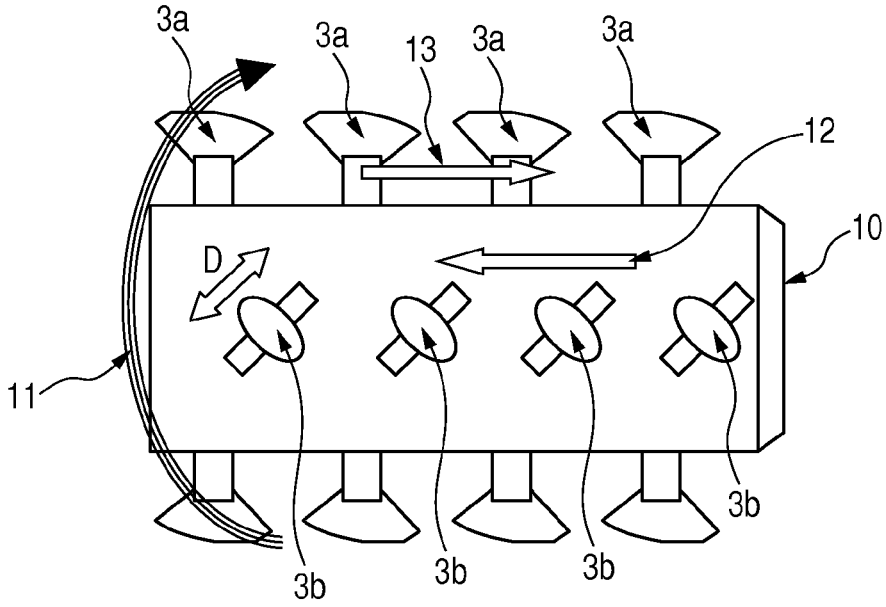
FIG. 6 is a schematic diagram illustrating a configuration of separate stirring members used in a coating apparatus that can be used in a method for producing a magnetic carrier of the present invention.

The shape of a stirring member 3 used in the present invention is not restricted to shapes schematically illustrated in FIGS. 3, 5 and 6, and may be, for example, a rectangular shape, a shape having a circular tip end or a paddle-like shape.

By disposing the stirring members as mentioned above, a material to be processed sent by the stirring member **3*b* from the rotor end side surface 10 to the direction (12) of the driver 8 and the material to be processed sent by the stirring blade 3*a* from a driver 8 side to the direction (13) of the rotor end side surface 10** are caused to collide.

That is, owing to a rotation of a rotor 2, transportation from the rotor end side surface 10 to the driver direction (12) and transportation to the anti-driver direction (13) are repeated and furthermore owing to the overlapping width C, collision of the material to be processed repeatedly occurs. Thereby, a transfer pathway of a material to be processed in the body casing 1 becomes complicated and takes a long distance to promote uniform mixing and coating of the material to be processed.

In the present invention, it is also important that the resin composition particles has a 50% particle diameter (D50) based on volume in the range from 0.2 μm or more to 6.0 μm or less and the proportion of particles of 10.0 μm or more is in an amount of 2.0% by volume or less. It was found that when particle diameters of resin composition particles are set in the above range, residual resin composition particles can be reduced and uniform coating can be conducted.

As a result of the study by the present inventors, it was found that the ratio of particles of 10.0 μm or more and the residual resin composition particles are deeply related.

In a coating step, resin composition particles are sandwiched between magnetic carrier core particles and thereby the resin composition particles are flattened. At that time, pressure is instantaneously applied on the resin composition particles to heat the particles, and thereby a surface of the magnetic carrier core particles is coated therewith. Then, by taking above-mentioned complicated path, heat can be rapidly dissipated; accordingly, the magnetic carriers become difficult to coalesce with each other. The resin composition particles of 10.0 μm or more are flattened with difficulty and less generate heat; accordingly, the resin composition particles are not easily coated with magnetic carrier core particles to remain as the resin composition particles to the last, and thereby the resin composition particles tend to result in forming residual resin composition particles. When the coating proceeds in a state where residual resin composition particles are present, a coating speed fluctuates between particles of the magnetic carrier; accordingly, even when the residual resin composition particles are simply eliminated from the magnetic carrier having been coated, the problem cannot be improved. In this case, a quantity of triboelectricity is destabilized or a resin composition layer tends to peel off from the magnetic carrier.

Accordingly, when the range of a 50% particle diameter (D50) based on volume of the resin composition particles is optimized and the proportion of particles of 10.0 μm or more is reduced, the residual resin composition particles can be reduced.

As a result of a study by the present inventors, the resin composition particles used in the present invention has a 50% particle diameter (D50) based on volume of the resin composition particles preferably in the range from 0.2 μm or more to 6.0 μm or less. Furthermore, the D50 of the resin composition particles is more preferable from 0.4 μm or more to 5.8 μm or less.

When the 50% particle diameter (D50) based on volume of the resin composition particles is less than 0.2 μm, the resin composition particles form secondary particles to result in existing as strongly aggregated particles of 10.0 μm or more. Accordingly, in some cases, layer thickness irregularity may occur on a surface of coated magnetic carrier, particle interfaces may exist, and many residual resin composition particles may remain. Furthermore, when the D50 of the resin composition particles exceeds 6.0 μm, it is difficult to reduce the residual resin composition particles. Still furthermore, the ability of the carrier to impart charges to a toner cannot be well controlled.

Furthermore, the proportion of particles of 10.0 μm or more in the resin composition particles should be 2.0% by volume or less and preferably 1.5% by volume or less. When the proportion exceeds 2.0% by volume, the residual resin composition particles cannot be reduced to result in producing fluctuation in the ability of providing charges to toner.

Still furthermore, in the present invention, when the total volume of the magnetic carrier core particles and the resin composition particles is taken as A, the minimum gap between an inner peripheral surface of the body casing and the stirring member is taken as d, and the volume of a cylindrical space having a thickness d toward a center direction from the inner peripheral surface of the body casing is taken as B, the A and the B preferably satisfy a relationship represented by the following formula:

$$1.1 \leqq A/B \leqq 4.0.$$

Furthermore, a relationship represented by the following formula is more preferably satisfied:

$$1.5 \leqq A/B \leqq 3.5.$$

Figure 2:
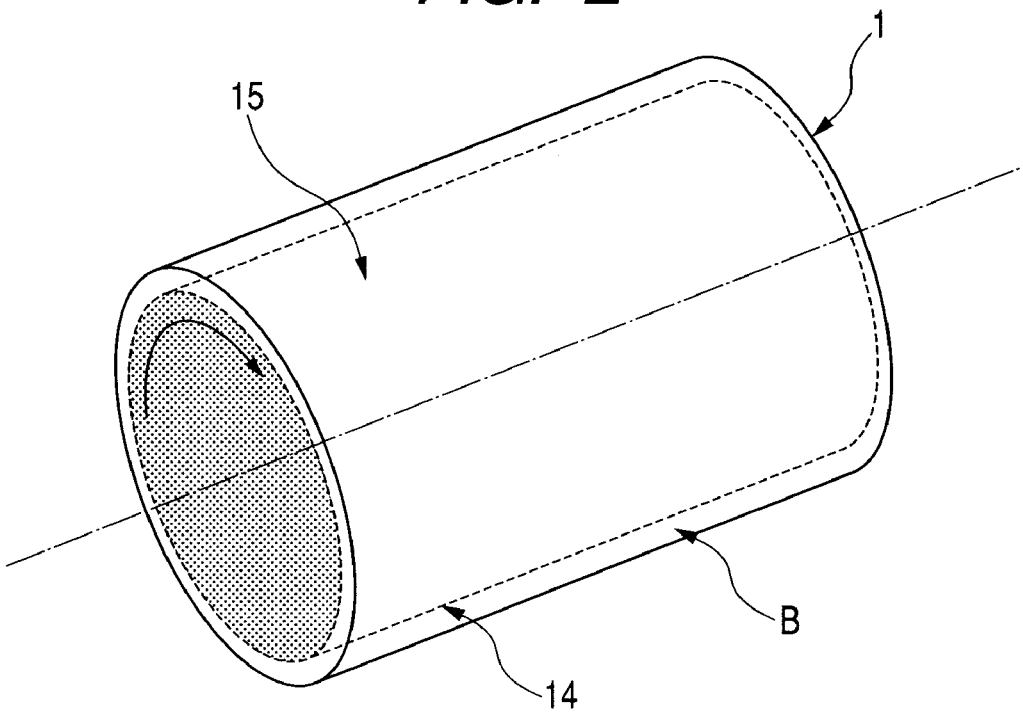
FIG. 2 is a drawing describing a volume B in a coating apparatus.

In the present invention, the volume (effective processing volume) B means, as illustrated in FIG. 2, a space volume obtained by subtracting a rotation volume 15 calculated from a trajectory 14 of the stirring member 3 formed by a rotation of the rotor 2 from a volume of the body casing 1.

As a result of the study by the present inventors, when the foregoing formula is satisfied, cracks and chips on a surface of the magnetic carrier can be excellently suppressed. Furthermore, the residual resin composition particles can be more excellently reduced and thereby more uniform coating can be conducted.

When the A/B is small, in order to impart appropriate load power during the coating process, peripheral speed of rotation of the rotor 2 has to be increased. Accordingly, it is considered that stirring and mixing tend to be excessive and thereby the magnetic carrier surface is likely to slightly generate cracks and chips. Furthermore, when the peripheral speed of rotation of the rotor 2 is slowed down, uniformity in the coating becomes slightly poor.

By contrast, when the A/B is large, in order to impart appropriate load power during the coating process, the peripheral speed of rotation of the rotor 2 needs to be slowed down. Accordingly, it is considered that the stirring and mixing cannot be thoroughly conducted and thereby the residual resin composition particles cannot be sufficiently reduced. Furthermore, when the peripheral speed of rotation of the rotor 2 is sped up, cracks and chips are likely to occur slightly on the magnetic carrier surface.

Furthermore, the present invention is characterized in that when an overlapping width of the trajectories is taken as C, and the maximum widths of the stirring member 3*a* on an upstream side and the stirring member 3*b* on a downstream side, respectively, are taken as $D_{3a}$ and $D_{3b}$, the overlapping width C and the maximum widths D of the stirring members is preferred to satisfy a relationship represented by the following formulas:

$$0.05 \leqq C/D_{3a} \leqq 0.50 \text{ and}$$

$$0.05 \leqq C/D_{3b} \leqq 0.50.$$

The following formulas are more preferably satisfied:

$$0.10 \leqq C/D_{3a} \leqq 0.45 \text{ and}$$

$$0.10 \leqq C/D_{3b} \leqq 0.45.$$

In the present invention, the overlapping width C of the stirring member 3 is, as illustrated in FIG. 4, a value obtained by directly overlapping the stirring member 3*a* and the stirring member 3*b* and by actually measuring an overlapping width, and the maximum width D of the stirring member 3 is, as illustrated in FIG. 4, a value obtained by actually measuring a width of the stirring member 3.

When the C/D satisfies the above formulas, during the coating process, cracks and chips on the magnetic carrier surface can be excellently inhibited from occurring. Furthermore, the residual resin composition particles can be well reduced and thereby more uniform coating can be conducted.

When the C/D is too large, in order to impart appropriate load power during the coating process, the peripheral speed of rotation of the rotor 2 needs to be slowed down. Accordingly, it is considered that since the stirring and mixing cannot be thoroughly conducted, the residual resin composition particles cannot be sufficiently reduced. Furthermore, when the peripheral speed of rotation of the rotor 2 is increased, cracks and chips are likely to occur slightly on the magnetic carrier surface.

By contrast, when the C/D is too small, in order to impart appropriate load power during the coating process, a peripheral speed of rotation of the rotor 2 has to be increased. Accordingly, it is considered that since the stirring and mixing tend to be excessive, cracks and chips are likely to occur slightly on a magnetic carrier surface. Furthermore, when the peripheral speed of rotation of the rotor 2 is slowed down, uniformity of the coating is slightly poor.

The C/D that is a relationship of the overlapping width C and the maximum width D of the stirring member 3 can be conveniently controlled by varying a length E of a rotor 18 illustrated in FIGS. 4 and 5 with the maximum width D of the stirring member 3 fixed.

Furthermore, in the present invention, in order to suppress the coalescence between magnetic carriers each other to suppress the residual resin composition particles from occurring, during the coating process, a temperature T (° C.) of a material to be processed that is magnetic carrier core particles and resin composition particles is preferably controlled in a range satisfying the following formula:

$$Tg-50 \leqq T \leqq Tg+20$$

(Tg: the glass transition temperature (° C.) of a resin component contained in the resin composition particles)

Furthermore, $$Tg-50 \leqq T \leqq Tg+5$$

is more preferably satisfied.

In the present invention, the glass transition temperature (Tg) of a resin component contained in resin composition particles for coating is preferably set to from 70° C. or more to 130° C. or less and more preferably to from 80° C. or more to 120° C. or less. Thereby, without generating cracks of a coated layer of a magnetic carrier surface, a coated film excellent in the endurance can be preferably prepared.

The temperature T (° C.) of a material to be processed during the coating process means an atmospheric temperature inside of the body casing 1 during the coating process, and, specifically, the maximum temperature during the coating process when a thermocouple is attached to an inner wall surface of the body casing 1 from the outside of an apparatus to measure a thermal history during the coating process.

In the case of conventional heat-dry-coating, the temperature T (° C.) of a material to be processed during the coating process should be somewhat higher than the glass transition temperature (Tg) of a resin component contained in the resin composition particles. Accordingly, an entire apparatus was heated by causing a heat medium to flow in a jacket disposed inside of a body casing.

However, as the temperature T (° C.) of a material to be processed during the coating process is made higher, the coating with coarse resin composition particles such as exceeding 10.0 μm becomes possible, while the material to be processed tends to exist in a localized state, stagnate or aggregate. Furthermore, coalescence of the magnetic carrier is promoted to be unable in some cases to conduct uniform coating. On the other hand, when the temperature T (° C.) of the material to be processed during the coating process is lowered, adherence of the resin composition particles to a surface of the magnetic carrier core particles and the coating process itself become insufficient, and thereby, suppression of coalescence of the magnetic carrier and uniform coating are very difficult to achieve at the same time.

In a coating apparatus used in the present invention, a reason why a processing temperature can be lowered is considered as described below. By repeating the transportation from the rotor end side surface 10 to the direction of the driver 8 (12) and transportation from the driver 8 to the direction of the rotor end side surface 10 (13), in addition to a collision of an inner wall of body casing 1 and the stirring member 3 with the material to be processed, collisions between materials to be processed each other are effectively and frequently caused. Thereby, in a very minute region of one magnetic carrier particle, heat is instantaneously imparted and a temperature of the material to be processed is locally raised to Tg+10° C. or more. However, heat is not imparted to a region other than the processed region and the temperature of an entire magnetic carrier does not increase. Accordingly, coalescence of magnetic carrier can be suppressed and irregularity of a coated layer caused by disintegration of the coalesced magnetic carrier can be eliminated.

In the present invention, in order to control the temperature T (° C.) of the material to be processed during the coating process, the rotor 2 to which a cooling medium can be flowed or the body casing 1 provided with the jacket 4 can be preferably used. Examples of the cooling medium include fluids such as cooling chiller water, hot water, steam, and oil.

Furthermore, like the case where after resin composition particles are input, a first coating process is conducted, and resin composition particles are further input for coating, when the resin composition particles are input by dividing into a plurality of times for coating, more uniform coating process can be conducted.

In the case where the coating process is conducted a plurality of times, when an amount of resin composition particles input at a first time is taken as E parts by mass and an amount of the resin composition particles input after the first time is taken as F parts by mass, the input amount E of the resin composition particles is, based on 100.0 parts by mass of magnetic carrier core particles, preferably from 0.1 parts by mass or more to 1.0 parts by mass or less and more preferably from 0.2 parts by mass or more to 0.9 parts by mass or less. Furthermore, the input amount E of the resin composition particles and the input amount F of the resin composition particles is preferred to be in a relationship of E<F.

Figure 7:
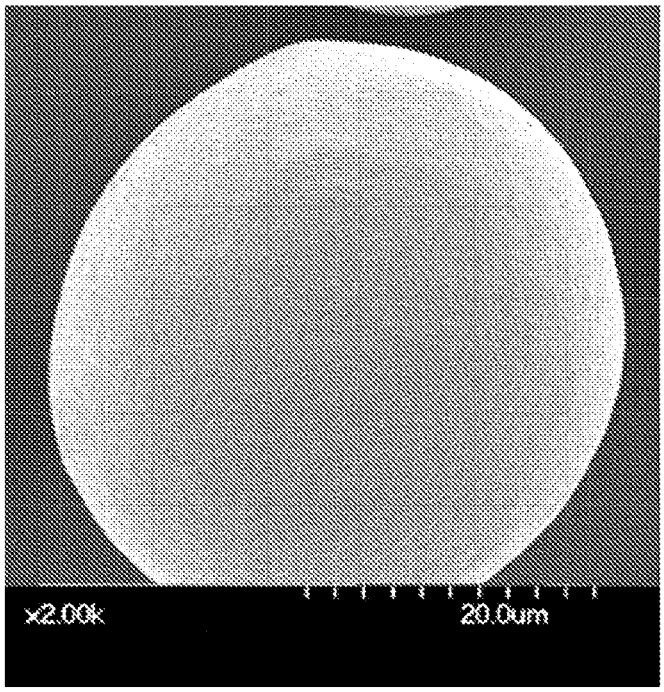
FIG. 7 is an example of an electron microscope (SEM) image of a magnetic carrier surface.
Figure 8:
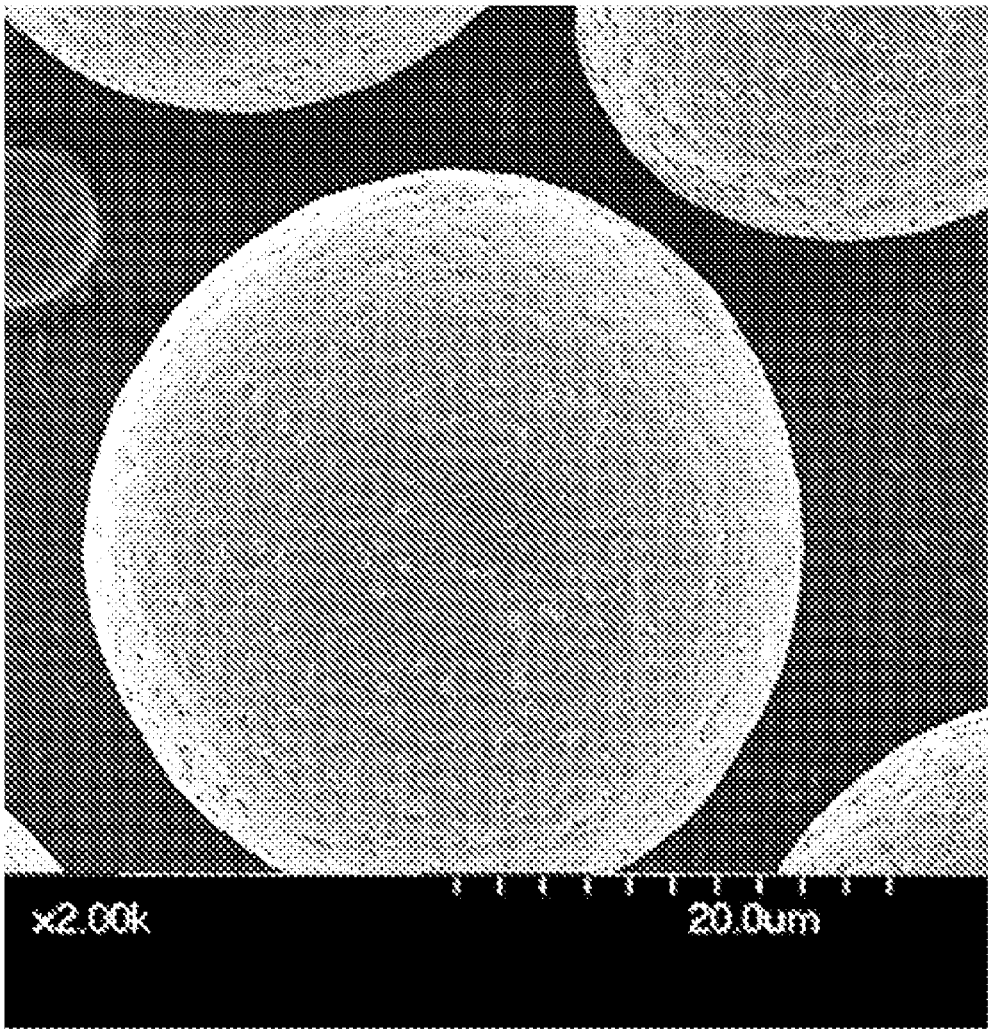
FIG. 8 is another example of an electron microscope (SEM) image of a magnetic carrier surface.

By coating with the input amount E of the resin composition particles, recess portions of irregular portions present on a surface of the magnetic carrier core particles are firstly coated to make differences of irregularities on a surface of carrier core particles smaller and furthermore a thin layer of resin composition particles can be formed on a surface of the magnetic carrier core particles. In addition, FIG. 8 illustrates an example of a magnetic carrier produced when a total amount of the resin composition particles is input at once, and FIG. 7 illustrates an example of a magnetic carrier produced when the resin composition particles are input by dividing into two times.

Then, when coating with an input amount F of the resin composition particles is conducted, a thickness irregularity of a coated layer of the resin composition particles can be suppressed and the residual resin composition particles can be reduced.

The number of times of coating with the resin composition particles may be any of two times or more. However, two times is preferable from the economical efficiency point of view. At this time, an input amount F of the resin composition particles is preferably from 0.5 parts by mass or more to 5.0 parts by mass or less and more preferably from 1.0 part by mass or more to 4.0 parts by mass or less.

In the present invention, a coating time of a material to be processed is, in the case where an effective process volume of a process space (volume B in FIG. 2) is $2.0\times10^{-3}$ $m^3$, preferably from 2 min or more to 60 min or less. At the time of scale-up, from a product of the above-mentioned coating time and a cubic root of multiple number of a volume of a process space 9, an appropriate coating time is obtained. For example, 10 minutes in a process time in an apparatus having an effective volume of the process space 9 of $2.0\times10^{-3}$ $m^3$ corresponds to 27 minutes ($\approx$10 minutes$\times20^{1/3}$) in an apparatus of which effective volume of the process space 9 is scaled-up to $4.0\times10^{-2}$ $m^3$.

Furthermore, in the present invention, the power imparted to a material to be processed is preferably from 45% or more to 85% or less of a rated power of the driver 8. For example, when a rating of the driver 8 is 5.5 kW, the power imparted to the material to be processed is preferably from 2.5 kW or more to 4.7 kW or less and when the rating of the driver 8 is 30.0 kW, the power imparted to the material to be processed is preferably from 13.5 kW or more to 25.5 kW or less.

In the present invention, a peripheral speed of rotation of the stirring member 3 is preferably controlled so that a power of the driver 8 may be in the above range. Specifically, at the outermost end of the stirring member, the peripheral speed of rotation is set preferably at from 5 m/sec or more to 30 m/sec or less and more preferably at from 10 m/sec or more to 20 m/sec or less.

Furthermore, in the present invention, the minimum gap between the body casing 1 and the stirring blade 3 is preferably from 0.5 mm or more to 30.0 mm or less and more preferably from 1.0 mm or more to 20.0 mm or less.

A magnetic carrier obtained according to the present invention has a 50% particle diameter (D50) based on volume preferably in the range from 20.0 μm or more to 100.0 μm or less and more preferably in the range from 25.0 μm or more to 60.0 μm or less.

When the 50% particle diameter (D50) based on volume of the magnetic carrier is in the range from 20.0 μm or more to 100.0 μm or less, the density of magnetic brush at a development pole is optimized, a charge amount distribution of a toner can be made sharp, high image quality can be achieved, and half-tone image quality can be improved.

Furthermore, the magnetic carrier core particles used in the present invention has a 50% particle diameter (D50) based on volume preferably in the range from 19.5 μm or more to 99.5 μm or less and more preferably in the range from 24.5 μm or more to 59.5 μm or less.

In the present invention, when the 50% particle diameter (D50) based on volume of the resin composition particles is taken as Db (μm) and the 50% particle diameter (D50) based on volume of the magnetic carrier core particles is taken as Dc (μm), Db/Dc, is preferably in a relationship of from 0.002 or more to 0.310 or less.

The magnetic carrier obtained according to a production method of the present invention has an average circularity preferably of from 0.920 or more to 1.000 or less and more preferably of from 0.950 or more to 1.000 or less from the view point of imparting adequate charges to the toner.

The magnetic carrier of the present invention preferably has, in a distribution of circularity based on the number, 10.0% by number or less of the magnetic carrier particles having a circularity of 0.900 or less from the viewpoint that even after the magnetic carrier is left under a high temperature and high humidity environment, the ability of imparting charges to the toner can be inhibited from deteriorating.

The magnetic carrier having a circularity of 0.900 or less in the distribution of circularity is amorphous particles, in particular, particles generated from cracks, chips, aggregation or the like, roughly means a magnetic carrier which does not undergo uniform coating processing.

In the next place, magnetic carrier core particles will be described.

Examples of the magnetic carrier core particles include magnetic ferrite particles containing one kind or two kinds or more selected from iron, lithium, beryllium, magnesium, calcium, rubidium, strontium, nickel, cobalt, manganese, chromium and titanium, or magnetite particles. Preferable examples include magnetite particles or ferrite particles containing at least one kind or two kinds or more selected from manganese, calcium, lithium and magnesium.

Examples of the ferrite particles include particles of iron-based oxides such as Ca—Mg—Fe-based ferrite, Li—Fe-based ferrite, Mn—Mg—Fe-based ferrite, Ca—Be—Fe-based ferrite, Mn—Mg—Sr—Fe-based ferrite, Li—Mg—Fe-based ferrite, Li—Ca—Mg—Fe-based ferrite and Li—Mn—Fe-based ferrite.

The ferrite can be obtained in such a manner that oxides, carbonates or nitrates of the respective metals are mixed in a wet form or a dry form, followed by calcining so that a desired ferrite composition may be obtained. Then, the resulting ferrite particles are pulverized to sub-micrometer. To the pulverized ferrite particles, from 20% by mass or more to 50% by mass or less of water and from 0.1% by mass or more to 10% by mass or less of, for example, polyvinyl alcohol (molecular weight: from 500 or more to 10,000 or less) as a binder resin are added to prepare a slurry. The slurry is granulated by the use of a spray dryer or the like and calcined to obtain a ferrite core.

As another method, a ferrite core can be obtained also by polymerizing under the presence of a magnetic material a monomer for forming a binder resin for a magnetic material dispersion type resin carrier core. Here, examples of monomers for forming the binder resin include what are described below.

That is, vinyl monomer, bisphenols and epichlorohydrin, used for forming epoxy resins; phenols and aldehydes, used for forming phenol resins; and urea and aldehydes, used for forming urea resins, and melamine and aldehydes.

A method of polymerizing phenol resins from phenols and aldehydes is particularly preferred. In this case, a magnetic material and phenols and aldehydes are added to an aqueous medium to polymerize the phenols and aldehydes in an aqueous medium in the presence of a basic catalyst, and thereby, a magnetic material dispersion type resin carrier core can be produced.

Example of magnetic materials used in the magnetic material dispersion type resin carrier core include magnetite particles and ferrite particles and its particle diameter is preferred to be from 0.02 μm or more to 2.00 μm or less.

The resin composition particles used in the present invention to coat a surface of magnetic carrier core will be described. The resin composition particles used in the present invention contains at least a resin component. As the resin component, a thermoplastic resin is used.

The resin component may be one kind of resin or a combination of two kinds or more of resins.

Examples of the thermoplastic resins as the resin component include polystyrene; acrylic resins such as polymethyl methacrylate and styrene-acrylic acid copolymer; a styrene-butadiene copolymer; an ethylene-vinyl acetate copolymer; polyvinyl chloride; polyvinyl acetate; a polyvinylidene fluoride resin; a fluorocarbon resin; a perfluorocarbon resin; a solvent-soluble perfluorocarbon resin; polyvinyl alcohol; polyvinyl acetal; polyvinyl pyrrolidone; a petroleum resin; cellulose; cellulose derivates such as cellulose acetate, cellulose nitrate, methyl cellulose, hydroxy methyl cellulose, hydroxy methyl cellulose, and hydroxy propyl cellulose; a novolac resin; low molecular-weight polyethylene; polyester resins such as a saturated alkyl polyester resin, polyethylene terephthalate, polybutylene terephthalate and polyallylate; a polyamide resin; a polyacetal resin; a polycarbonate resin; a polyether sulfone resin; a polysulfone resin; a polyphenylene sulfide resin; and a polyether ketone resin.

A tetrahydrofuran (THF)-soluble matter of a resin component contained in the resin composition particles has preferably a weight average molecular weight Mw of from 15,000 or more to 2,000,000 or less from the viewpoint of adhesiveness with a magnetic carrier core and capability of uniformly coating the surface of the magnetic carrier core particularly during coating. More preferably, the weight average molecular weight is from 50,000 or more to 700,000 or less.

Examples of methods of producing the resin composition particles include methods directly obtaining particles by suspension polymerization, emulsion polymerization and the like, and a method in which after particles are synthesized by solution polymerization, with the solution being removed by spray drying or the like, particles are prepared.

Furthermore, to the resin composition particles, microparticles having a number average particle diameter (D1) from 0.01 μm or more to 3.00 μm or less may be added. This is because such particles intervene between electrophotographic carrier core particles when a surface of electrophotography carrier core particles is coated with a resin component to exert a spacer effect to excellently control the coalescence of photographic carrier particles, and thereby coating uniformity can be more improved.

The microparticles contained in the resin composition particles may be microparticles of any of organic materials and inorganic materials. However, crosslinked resin microparticles and inorganic microparticles having strength capable of maintaining a shape of microparticles upon coating are preferred. Examples of crosslinked resins that form crosslinked resin microparticles include a crosslinked polymethyl methacrylate resin, a crosslinked polystyrene resin, a melamine resin, a guanamine resin, a urea resin, a phenol resin and a nylon resin. Examples of inorganic microparticles include magnetite, hematite, silica, alumina, and titania. In particular, the inorganic microparticles are preferred from the viewpoint of acceleration of imparting charges to toner, a decrease in charge-up and an improvement in releasability off the toner. Furthermore, a shape of microparticles is preferred to be spherical to obtain the spacer effect during coating process.

Furthermore, the microparticles contained in the resin composition particles form irregularity on a surface of a carrier for electrophotography after the coating process to work also so as to enhance the charge-imparting property to the toner. From this point of view, volume resistance is preferred to be $1\times10^{6}\Omega\cdot$cm or more.

Still furthermore, the resin composition particles may further contain conductive microparticles. The conductive microparticles has a volume resistance preferably of $1\times10^{8}\Omega\cdot$cm or less and more preferably of from $1\times10^{6}\Omega\cdot$cm or more to less than $1\times10^{6}\Omega\cdot$cm.

Examples of the conductive microparticles include carbon black microparticles, graphite microparticles, zinc oxide microparticles and tin oxide microparticles. As the conductive microparticles, carbon black microparticles are particularly preferred. These conductive microparticles, because of good conductivity thereof, can appropriately control specific resistance of the electrophotographic carrier even when the microparticles are added in a small amount.

Known toners can be used as a toner that is mixed with a magnetic carrier of the present invention and used. Any of toners produced by any of a pulverizing method, a polymerization method, an emulsion aggregation method, a dissolution suspension method and the like can be used.

In the next place, measurement methods involved in the present invention will be described.

<Measurement for Glass Transition Temperature (Tg) of Resin Composition Particles>

The glass transition temperature (Tg) of resin composition particles is measured with a differential scanning calorimeter (trade name: Q1000, manufactured by TA Instruments Ltd.) according to ASTM D3418-82.

Melting temperatures of indium and zinc are used to calibrate temperatures of an apparatus detector and heat of fusion of indium is used to calibrate calorie.

Specifically, about 10 mg of resin composition particles is precisely measured and put in an aluminum pan, and, with a vacant aluminum pan as a reference, a measurement is conducted in the range of 30 to 200° C. at a temperature-increase rate of 10° C./min. In the course of temperature increase, in the temperature range of 40° C. to 100° C., a variation of specific heat is obtained. An intersection between a line at an intermediate point of a base line before and after appearance of the specific heat variation and a differential heat curve is taken as the glass transition temperature Tg of the resin composition particles.

<Measurement Methods For 50% Particle Diameters (D50) Based on Volume of Magnetic Carrier Cores, Resin Composition Particles and Magnetic Carriers and for the Content of Particles of 10.0 μm or More in Resin Composition Particles>

A particle diameter distribution is measured by installing a dry measurement sample feeder (trade name: One-shot dry Sample Conditioner Turbotrac, manufactured by Nikkiso Co., Ltd.) to a laser diffraction/scattering type particle diameter analyzer (trade name: MICROTRACK MT3300EX, manufactured by Nikkiso Co., Ltd.).

For feeding conditions of Turbotrac, a dust collector is used as a vacuum source, an air flow is set at 33 L/sec and pressure is set at 17 kPa. The control of the measurement is automatically conducted on a software program. A 50% particle diameter (D50) that is a cumulated value based on volume is obtained as a particle diameter and the content of particles of 10.0 μm or more is determined. The control and analysis are conducted by the use of an accessory soft (version 10.3.3-202D).

The measurement conditions are as follows. SetZero time: 10 seconds, measurement time: 10 seconds, and measurement frequency: one time. Particle refractive index is 1.81, a particle shape is non-spherical, a measurement upper limit is set at 1408 μm and a measurement lower limit is set at 0.243 μm. A measurement is conducted under a normal temperature and normal humidity (23° C. and 50% RH) environment.

<Measurement for Molecular Weight of a Resin Component Contained in Resin Composition Particles>

A molecular weight distribution of a tetrahydrofuran (THF)-soluble matter of resin component contained in resin composition particles is measured by gel permeation chromatography (GPC) as shown below.

Firstly, the resin composition particles are dissolved in tetrahydrofuran (THF) over 24 hours at 23° C. The resulting solution is filtered with a solvent-resistant membrane filter having a pore diameter of 0.2 μm (trade name: MAESHORI DISK, manufactured by Tosoh Corporation) to obtain a sample solution. The sample solution is adjusted so that a concentration of a THF-soluble component may be 0.8% by mass.

The sample solution is subjected to a measurement under the following conditions.

Instrument: HLC 8120 GPC (Detector: RI) (manufacture by Tosoh Corporation)
Column: 7 columns of Shodex KF-801, 802, 803, 804, 805, 806, and 807 in series (trade name, manufactured by Showa Denko K.K.)
Eluent: Tetrahydrofuran (THF)
Flow rate: 1.0 ml/min
Oven temperature: 40.0° C.
Amount of injected sample: 0.10 ml For calculating a molecular weight of a sample, a molecular weight calibration curve prepared using standard polystyrene resins is used. Examples of the standard polystyrene resins specifically include TSK Standard Polystyrenes F-850, F-450, F-288, F-128, F-80, F-40, F-20, F-10, F-4, F-2, F-1, A-5000, A-2500, A-1000 and A-500 (trade name, manufactured by Tosoh Corporation).

<Measurements for Average Circularity of Magnetic Carrier Cores, Average Circularity of Magnetic Carriers and Proportion of Magnetic Carriers Having a Circularity of 0.900 or Less>

Average circularities of magnetic carrier cores and magnetic carriers and a proportion of magnetic carriers having a circularity of 0.900 or less are measured with a flow-type particle image analyzer "FPIA-3000" (trade name, manufactured by Sysmex Corporation) under the following analysis conditions.

At the time of measurement, before start of measurement, standard latex particles (for example, 5200A (trade name, manufactured by Duke Scientific Co.) diluted with ion exchanged water) are used to conduct automatic focus control. After the automatic focus control, a dispersion solution for measurement is prepared.

Specifically, to 20 ml of ion exchanged water poured in a beaker, as a dispersant, an appropriate amount of a surfactant, preferably, alkyl benzene sulfonate is added, followed by adding 0.3 g of a measurement sample.

Then, a bench ultrasonic washing disperser with an oscillation frequency of 50 KHz and an electrical output of 150 W (such as "VS-150" (trade name, manufactured by VELVO CLEAR Co., Ltd.)) is used for dispersion for 2 minutes to prepare a dispersion solution for measurement.

The flow-type particle image analyzer mounted with a standard objective lens (at a magnification of 10) is used to measure average circularities of magnetic carrier cores and magnetic carriers, the dispersion liquid prepared according to the above-mentioned procedure is introduced into the flow-type particle image analyzer, and 500 magnetic carrier cores and magnetic carriers are measured according to the total count mode of an HPF measurement mode.

At that time, as the measurement conditions, with a binarization threshold at the time of particle analysis set to 85%, with a circle equivalent diameter based on the number, with the particle diameter limit set to from 19.92 μm or more to 200.00 μm or less and with the shape limit set to from 0.20 or more to 1.00 or less, the average circularities of magnetic carrier cores and magnetic carriers are obtained.

The flow-type particle image analyzer mounted with a standard objective lens (at a magnification of 10) is used also to measure the proportion of particles of magnetic carriers having a circularity of 0.900 or less, a dispersion liquid prepared according to the above-mentioned procedure is introduced into the flow-type particle image analyzer, and 500 magnetic carriers are measured according to the total count mode of an HPF measurement mode.

At that time, as the measurement conditions, firstly, with a binarization threshold at the time of particle analysis set to 85%, with a circle equivalent diameter based on the number, with the particle diameter limit set to from 19.92 μm or more to 200.00 μm or less and with the shape limit set to from 0.20 or more to 0.90 or less, magnetic carriers are measured to obtain the number of particles having a circularity of 0.900 or less of the magnetic carriers. In the next place, with the circle equivalent diameter based on the number, with the particle diameter limit set to from 19.92 μm or more to 200.00 μm or less as before and with the shape limit set to from 0.20 or more to 1.00 or less, the number of particles of the magnetic carriers having a circularity of 1.00 or less is obtained.

When the number of particles of the magnetic carriers having a circularity of 0.900 or less is divided by the number of particles of the magnetic carriers having an average circularity of 1.000 or less, the proportion of magnetic carriers having a circularity of 0.900 or less is obtained.

<Measurement of Residual Resin Composition Particles in Magnetic Carrier>

The flow-type particle image analyzer mounted with a standard objective lens (at a magnification of 10) is used also in the measurement of residual resin composition particles in the magnetic carrier, a dispersion liquid prepared according to the above-mentioned procedure is introduced into the flow-type particle image analyzer, and 500 magnetic carriers are measured according to the total count mode of an HPF measurement mode.

At that time, as the measurement conditions, with a binarization threshold at the time of particle analysis set to 85%, with a circle equivalent diameter based on volume, with the particle diameter limit set to from 0.500 μm or more to 19.92 μm or less and with the shape limit set to from 0.200 or more to 1.000 or less, the magnetic carriers are measured to obtain the abundance ratio of particles present within the particle diameter limits and this is regarded as the residual resin composition particles.

EXAMPLES

In what follows, the present invention will be more detailed with reference to specific production examples and Examples without restricting the present invention thereto.

<Production Example for Magnetic Carrier Core a>

Magnetite particles (number-average particle diameter: 0.3 μm) and a silane coupling agent (3-(2-aminoethylaminopropyl)trimethoxysilane) were introduced into a vessel. At that time, the silane coupling agent was introduced so as to be in an amount of 3.0% by mass based on the mass of the magnetite particles. In the vessel, high-speed mixing/stirring was conducted at 110° C. to treat the surface of the magnetite particles.

Then, with materials shown below, magnetic carrier core a was produced.

Phenol: 10.0 parts by mass
Formaldehyde solution (37% by mass aqueous solution): 6.0 parts by mass
Surface-treated magnetite particles: 84.0 parts by mass The foregoing materials, 5 parts by mass of 28% by mass ammonia water and 25 parts by mass of water were input in a flask, followed by, under mixing, heating up to 85° C. over 30 minutes followed by keeping there, further followed by polymerizing for 3 hours to cure. Thereafter, the resultant was cooled to 30° C., after water was further added, a supernatant liquid was removed, a precipitate was washed with water, followed by drying in air. Then, the precipitate was dried at a temperature of 60° C. under reduced pressure (5 hPa or less) and thereby magnetic microparticle dispersed magnetic carrier core a where the magnetite particles are dispersed in the phenol resin was obtained. The resulting magnetic carrier core a had a 50% particle diameter (D50) based on volume of 37.2 μm. Furthermore, the average circularity thereof was 0.970 and the proportion of particles having a circularity of 0.900 or less was 4.0% by number.

<Production Example for Magnetic Carrier Core b>

Materials shown below were used to produce a magnetic carrier core b.

| | |
|---|---|
| $Fe_2O_3$: | 66.5 parts by mass |
| $MnCO_3$: | 28.1 parts by mass |
| $Mg(OH)_2$: | 4.8 parts by mass |
| $SrCO_3$: | 0.6 parts by mass |

The above-mentioned respective materials were wet-mixed, followed by calcining at 900° C. for 2 hours, further followed by pulverizing the calcined ferrite composition with a ball mill. The resulting pulverized material had a number average particle diameter of 0.8 μm. To the resulting pulverized material, water (300 parts by mass based on the pulverized material) and polyvinyl alcohol having a weight average molecular weight of 5,000 (3 parts by mass based on the pulverized material) were added, followed by granulating with a spray dryer.

Then, the granulated material was sintered at 1300° C. for 6 hours in an electric furnace under a nitrogen atmosphere having an oxygen concentration of 2.0%, followed by pulverizing, further followed by classifying, thereby magnetic carrier core b having a Mn—Mg—Sr—Fe ferrite composition was obtained.

The resulting magnetic carrier core b had a 50% particle diameter (D50) based on volume of 42.3 μm. The average circularity thereof was 0.950 and the proportion of particles having a circularity of 0.900 or less was 6.0% by number.

<Production Example for Magnetic Carrier Core c>

With the same materials as the magnetic carrier core a, magnetic carrier core c was obtained in a manner similar to the magnetic carrier core a except that the 28% by mass ammonia water was changed to 7 parts and the water was changed to 40 parts by mass.

The resulting magnetic carrier core c has a 50% particle diameter (D50) based on volume of 26.3 μm. Furthermore, the average circularity thereof was 0.964 and the proportion of particles having a circularity of 0.900 or less was 6.1% by number.

<Production Example for Magnetic Carrier Core d>

Magnetic carrier core d was obtained in a manner similar to the magnetic carrier core b except that the amount of water added during granulation was changed to 250 parts by mass based on the pulverized material and the amount of polyvinyl alcohol was changed to 1.5 parts by mass based on the pulverized material.

The resulting magnetic carrier core d had a 50% particle diameter (D50) based on volume of 57.9 μm. Furthermore, the average circularity thereof was 0.954 and the proportion of particles having a circularity of 0.900 or less was 5.1% by number.

<Production Example 1 of Resin Composition Particles>

Firstly, in a four-necked separable flask equipped with a stirrer, a condenser, a thermometer and a nitrogen introducing tube, 100.0 parts by mass of methanol as a solvent and 200.0 parts by mass of methyl ethyl ketone were charged. Furthermore, 400.0 parts by mass of methyl methacrylate monomer, 100.0 parts by mass of cyclohexyl methacrylate monomer and 3.0 parts by mass of azobisisovaleronitrile as a polymerization initiator were charged. In this state, under stirring and nitrogen introduction, a solution polymerization was conducted under the condition of 65° C. for 12 hours and thereby a solution containing a polymer was obtained.

In the next place, in a four-necked separable flask equipped with a stirrer, a Liebig condenser and a thermometer, 500 parts by mass of hexane-exchanged water was charged. Furthermore, in the hexane-exchanged water, 100.0 parts by mass of the solution containing the polymer were charged, a solvent was removed while heating/stirring for 10 hours under the condition of 95° C. or less, and thereby a resin dispersion solution was obtained. The resulting resin dispersion solution was filtered to obtain a resin component. The resin component was then dried at 50° C. until the resin content became 99.5% or more, and thereby resin composition particles were obtained.

The resulting resin composition particles were micropulverized by a crusher, thereby producing micropulverized particles having a 50% particle diameter (D50) based on volume of 8.1 μm and containing 17.8% by volume of particles having a particle diameter of 10.0 μm or more.

The resulting micropulverized particles were classified by an air flow classifier and thereby resin composition particles 1 having a 50% particle diameter (D50) based on volume of 1.5 μm and containing 0.1% by volume of particles having a particle diameter of 10.0 μm or more were obtained.

The resulting resin composition particles 1 had a weight average molecular weight (Mw) of 51,000 and the resin component contained had a glass transition temperature (Tg) of 98.0° C.

<Production Examples 2 to 6 for Resin Composition Particles>

Resin composition particles 2 to 6 having particle diameters such as shown in Table 1 were obtained in a manner similar to Production example 1 except that classifying condition for the micropulverized particles was changed.

<Production Example 7 for Resin Composition Particles>

Into a 5-liter separable flask equipped with a stirrer, a thermometer, a nitrogen-introducing tube, a dropping funnel and a reflux cooling tube, 2,750 parts by mass of ion-exchanged water, 1.0 parts by mass of polyvinyl alcohol and 750 parts by mass of methyl methacrylate were charged.

Then, a temperature was raised while stirring under nitrogen flow, 4.0 parts by mass of potassium persulfate and 4.4 parts by mass of sodium thiosulfate were put in to start polymerization.

At 15 minutes after the polymerization started, 7.5 parts by mass of methacrylic acid and 250 parts by mass of ion-exchanged water were quantitatively dropped for 15 minutes, followed by keeping a reaction temperature at 70° C. to carry out a reaction for 3 hours, and thereby the polymerization was completed.

To 100 parts by mass of the polymer, 2.5 parts by mass of magnesium acetate were added. The resulting polymer latex had a pH of 6.5.

The resulting polymer latex was filtered with a 400-mesh metal net, followed by drying the latex with a spray dryer, further followed by pulverizing by a jet mill, thereby producing resin composition particles 7 having a 50% particle diameter (D50) based on volume of 0.9 μm and containing 0.0% by volume of particles having a particle diameter of 10.0 μm or more.

<Production Examples 8 and 9 for Resin Composition Particles>

Resin composition particles 8 and 9 having particle diameters shown in Table 1 were obtained in a manner similar to Production example 7 except that the disintegration condition by a jet mill was changed.

<Production Example 10 for Resin Composition Particles>

In a four-necked separable flask equipped with a stirrer, a condenser, a thermometer and a nitrogen introducing tube, 20 parts by mass of polyoxypropylene glycol was dissolved in 900 parts by mass of ion-exchanged water, thereby an aqueous medium heated at 60° C. was obtained.

| | |
|---|---|
| Cyclohexyl methacrylate monomer | 50 parts by mass and |
| methyl methacrylate monomer | 50 parts by mass |

The above materials were heated to 60° C., followed by uniformly dissolving and dispersing at 12,000 rpm by the use of a TK TYPE HOMOMIXER (trade name, manufactured by Tokushu Kika Kogyo Co., Ltd.). Thereto, 1 part by mass of 2,2'-azobis(2,4-dimethylvaleronitrile) as a polymerization initiator was dissolved and thereby a monomer composition was prepared.

In the aqueous medium, the monomer composition was input, under a nitrogen atmosphere at a temperature of 60° C., stirred at 15,000 rpm for 10 minutes by the TK TYPE HOMOMIXER, followed by granulating the monomer composition. Thereafter, while stirring with a paddle stirring blade, a temperature was raised to 80° C. and a reaction was conducted for 10 hours. After the polymerization reaction was completed, a residual monomer was distilled away under reduced pressure, followed by, after cooling, filtering, washing with water and drying, thereby obtaining resin composition particles 10 having a 50% particle diameter (D50) based on volume of 1.9 μm and containing 0.0% by volume of particles having a particle diameter of 10.0 μm or more.

<Production Example 11 for Resin Composition Particles>

Into a four-necked separable flask equipped with a stirrer, a thermometer and a nitrogen introducing tube, 640 parts by mass of ion-exchanged water in which 1.0 parts by mass of polyoxyethylene lauryl ether sodium sulfate was dissolved were input, thereto 80 parts by mass of methyl methacrylate monomer and 80 parts by mass of cyclohexyl methacrylate monomer, which were prepared in advance, were charged, followed by heating to 60° C. while replacing with nitrogen under stirring. While maintaining an internal temperature at 60° C., 4 parts by mass of potassium persulfate as a polymerization initiator were added, followed by polymerizing for 12 hours. The resulting emulsion had an average particle diameter of 0.19 μm. After the polymerization reaction was completed, a residual monomer was distilled away under reduced pressure, followed by, after cooling, filtering, washing with water and drying, thereby obtaining resin composition particles 11 having a 50% particle diameter (D50) based on volume of 0.2 μm and containing 0.0% by volume of particles having a particle diameter of 10.0 μm or more.

TABLE 1

| Resin composition particles | Weight average molecular weight | Tg (° C.) | D50 (μm) | Proportion of particles of 10.0 μm or more (% by volume) |
|---|---|---|---|---|
| 1 | 51,000 | 98 | 1.5 | 0.1 |
| 2 | 51,000 | 98 | 3.5 | 0.5 |
| 3 | 51,000 | 98 | 4.5 | 1.5 |
| 4 | 51,000 | 98 | 6.0 | 2.0 |
| 5 | 51,000 | 98 | 6.5 | 5.0 |
| 6 | 51,000 | 98 | 5.9 | 2.3 |
| 7 | 50,000 | 108 | 0.9 | 0.0 |
| 8 | 50,000 | 108 | 0.2 | 0.0 |
| 9 | 50,000 | 108 | 0.1 | 0.0 |
| 10 | 1,905,000 | 107 | 1.9 | 0.0 |
| 11 | 487,000 | 117 | 0.2 | 0.0 |

<Production Example for Toner>

By the use of the following materials and production method, a toner was produced.

| | |
|---|---|
| Polyester resin (peak molecular weight Mp: 6,500, Tg: 65° C.): | 100.0 parts by mass |
| C.I. Pigment Blue 15:3: | 5.0 parts by mass |
| Paraffin wax (melting point: 75° C.): | 5.0 parts by mass |
| Aluminum compound of 3, 5-di-t-butyl salicylic acid : | 0.5 parts by mass |

Above-listed materials were mixed by a Henschel mixer, followed by melt-kneading by a biaxial extruder. The resulting kneaded material was cooled, crushed by a crusher to 1 mm or less, and thereby a roughly crushed material was obtained. The resulting roughly crushed material was micropulverized by a pulverizer, followed by classifying by an air classifier, thereby toner particles were obtained.

The resulting toner particles had a 50% particle diameter (D50) based on volume of 6.5 μm.

To 100.0 parts by mass of the resulting toner particles, materials shown below were added, followed by externally adding by the use of a Henschel mixer, thereby a toner was produced.

| | |
|---|---|
| Micropowder of anatase titanium oxide (specific surface area by BET: 80 $m^2/g$, treated with 12% by mass of isobutyltrimethoxysilane): | 1.0 parts by mass |
| Oil-processed silica (specific surface area by BET: 95 $m^2/g$, treated with 15% by mass of silicone oil): | 1.5 parts by mass |
| Sol-gel method spherical silica (treated with hexamethylsilazane, specific surface area by BET: 24 $m^2/g$, number-average particle diameter: 0.1 μm): | 1.5 parts by mass |

Example 1

In the present Example, an apparatus provided with a cylindrical body casing 1 having an inner diameter of 130 mm and a driver 8 having a rating power of 5.5 kW was used for coating. Furthermore, materials and a production method shown below were used to produce a magnetic carrier.

In the present Example, a volume A of the magnetic carrier core a and resin composition particles, which are materials to be processed, was set to $5.7\times10^{-4}$ $m^3$ and a volume B thereof was set to $2.7\times10^{-4}$ $m^3$, and thereby A/B was set to 2.1.

Furthermore, the maximum width D of the stirring member 3 was set to 25.0 mm and a length of the rotor 18 constituting the rotor 2 was controlled, thereby an overlapping width C of the stirring member 3*a* and the stirring member 3*b* was set to 4.3 mm and $C/D_{3a}$ and $C/D_{3b}$ were set to 0.17.

With the above-mentioned apparatus configuration, to 100.0 parts by mass of the magnetic carrier core particles a, 1.5 parts by mass of the resin composition particles 1 were added for coating.

During the coating, for efficient coating, a processing time was set to 10 minutes and a peripheral speed of the outermost end of the stirring member 3 was controlled to 11 m/sec so that the power of the driver 8 may be constant at 3.5 kW.

The resulting magnetic carrier was subjected to magnetic concentration, coarse particles were separated by a circular vibration sifter equipped with a screen having a diameter of 500 mm and an aperture of 75 μm, and thereby a magnetic carrier 1 was obtained.

The resulting magnetic carrier 1 had an average circularity of 0.975, the proportion of a magnetic carrier having a circularity of 0.900 or less was 0.2% by number and the residual resin composition particles in the magnetic carrier was 0.5% by volume.

Processing conditions for the magnetic carrier 1 are shown in Table 2. The magnetic carrier 1 was evaluated according to criteria shown below and evaluation results are shown together with physical properties of the magnetic carrier in Table 3.

Evaluation of Surface State of Magnetic Carrier

The resulting magnetic carrier was observed with an electron microscope (SEM) at a magnification of 2,000 times so that an entire magnetic carrier may be in one viewing field. This observation was repeated 15 times and the surface state of the magnetic carrier was evaluated according to the following evaluation criteria. Evaluation C or more satisfies a practical level in the present invention.

A: The number of the magnetic carriers having a grain interface is zero.

B: The number of the magnetic carriers having a grain interface is 3 or less.

C: The number of the magnetic carriers having a grain interface is more than 3 and 5 or less.

D: The number of the magnetic carriers having a grain interface is more than 5 and 7 or less.

E: The number of the magnetic carriers having a grain interface exceeds 7.

To 90.0 parts by mass of the resulting magnetic carrier, 10.0 parts by mass of the toner were added, a V-blender was used to mix for 10 minutes, and thereby a two-component developer was prepared.

As an image forming apparatus, a full-color copier IRC3220N (trade name, manufactured by Canon Inc.) was used. The two-component developer was charged in a developing unit at a cyan site to form an image, followed by conducting the following evaluations. Evaluation results are shown in Table 3.

Initial Charge Potential

Under an environment of 23° C. and 5% RH, a charge potential (Vd1) of a photosensitive member was controlled so that a developed amount of the toner on the photosensitive member may be 0.6 g/$cm^2$.

When a triboelectric charge amount of the toner is higher, an absolute value of the charge potential of the photosensitive member becomes lower, and when the triboelectric charge amount of the toner becomes lower, the absolute value of the charge potential of the photosensitive member becomes higher. Accordingly, the charge potential of the photosensitive member is a value reflecting a charge amount of the toner and can be regarded as an indicator of the charge-imparting ability of the magnetic carrier.

A: The absolute value of the charge potential Vd1 is less than 550 V.

B: The absolute value of the charge potential Vd1 is from 550 V or more to less than 600 V.

C: The absolute value of the charge potential Vd1 is from 600 V or more to less than 650 V.

D: The absolute value of the charge potential Vd1 is from 650 V or more to less than 700 V.

E: The absolute value of the charge potential Vd1 is more than 700 V.

Rate of Variation in Developability

Under an environment of 23° C. and 5% RH, in an image of which printing ratio is 1%, a toner was quantitatively replenished so that a toner density may be constant, 10,000 sheets of images were output, after the output of 10,000 images, under the conditions the same as the measurement of the initial charge potential (Vd10), the charge potential (Vd10) of the photosensitive member was measured. The rate of variation in the triboelectric charge potential at that time was calculated and thereby the rate of variation in developability was evaluated.

A: The rate of variation in the charge potential Vd10/Vd1 is 95% or more.

B: The rate of variation in the charge potential Vd10/Vd1 is from 85% or more to less than 95%.

C: The rate of variation in the charge potential Vd10/Vd1 is from 75% or more to less than 85%.

D: The rate of variation in the charge potential Vd10/Vd1 is from 65% or more to less than 75%.

E: The rate of variation in the charge potential Vd10/Vd1 is less than 65%.

Variation Rate of Image Density

As an initial evaluation, under an environment of 30° C. and 80% RH, a charge potential (Vd) of a photosensitive member was controlled so that a developed amount of the toner on the photosensitive member may be 0.6 g/$cm^2$, an image is output, and image density thereof was measured.

Then, similarly to the initial evaluation, in an image of which printing ratio is 1%, the toner was quantitatively replenished so that a toner concentration may be constant, 10,000 image were output, and an image density was measured after 10,000 images were output.

As the image density, a solid image was output, the density was measured with a densitometer X-Rite 500, and an image density was obtained by averaging data of 6 points. With the initial image density taken as D1 and the image density after 10,000 image output as D10, a variation rate of image density, D10/D1, was calculated, followed by evaluating according to the following criteria.

In addition, evaluation C or higher satisfies a practical level in the present invention.

A: The rate of variation of the image density D10/D1 is 95% or more.

B: The rate of variation of the image density D10/D1 is from 85% or more to less than 95%.

C: The rate of variation of the image density D10/D1 is from 75% or more to less than 85%.

D: The rate of variation of the image density D10/D1 is from 65% or more to less than 75%.

E: The rate of variation of the image density D10/D1 is less than 65%.

Maintainability of Q/M (mC/kg) on photosensitive member

At the evaluation, firstly, as an initial evaluation, under an environment of 30° C. and 80% RH, at a time point when an amount of toner applied to a photosensitive member became 0.6 g/cm$^2$, the toner on the photosensitive member was suctioned and collected with a metal cylindrical tube and a cylindrical filter.

At this time, an amount of charge Q accumulated by a capacitor through a metal cylindrical tube and a mass M of collected toner were measured, thereby a charge amount Q/M (mC/kg) per unit mass was calculated and thereby Q/M (mC/kg) on the photosensitive member was obtained.

With the initial Q/M on the photosensitive member assigned to 100%, subsequently, under an environment of 30° C. and 80% RH, 10,000 images with a printing ratio of 40% were output, after 10,000 images were output, a maintenance rate of Q/M on the photosensitive member was calculated, followed by evaluating according to the following criteria.

In addition, evaluation C or more satisfies a practical level in the present invention.

A: The maintenance rate of Q/M on the photosensitive member is 90% or more.

B: The maintenance rate of Q/M on the photosensitive member is from 80% or more to less than 90%.

C: The maintenance rate of Q/M on the photosensitive member is from 70% or more to less than 80%.

D: The maintenance rate of Q/M on the photosensitive member is from 60% or more to less than 70%.

E: The maintenance rate of Q/M on the photosensitive member is less than 60%.

Leakage

At the evaluation, under an environment of 30° C. and 80% RH, a toner layer on the photosensitive member at the time point when an amount of toner applied to the photosensitive member became 0.4 g/cm$^2$ and an output solid image were visually evaluated, followed by evaluating according to the following criteria.

The leakage means a phenomenon where, when the toner coverage on a surface of the magnetic carrier is reduced, charges move from a development bearing member to a photosensitive member surface via the magnetic carrier.

When the leakage phenomenon occurs, a potential of a latent image converges to a development potential to be incapable of developing. As the result thereof, a leakage mark (a place where a toner layer disappears to be able to see a photosensitive member) appears on a toner layer on a photosensitive member or when the leakage is remarkable, a leakage mark (a place where a void is generated) appears also on a solid image.

Evaluation C or above satisfies a practical level in the present invention.

A: No leakage mark is found on a toner layer on the photosensitive member.

B: Slight leakage marks are found on a toner layer on the photosensitive member.

C: Leakage marks are found on a photosensitive member but not found on a solid image.

D: Slight leakage marks are found also on a solid image.

E: Many leakage marks are found over the entire solid image.

Maintainability of Q/M (mC/kg) After Leaving

Firstly, under an environment of 23° C. and 50% RH, 10,000 images with a printing ratio of 30% were output, and after output of 10,000 images, the Q/M on a photosensitive member was measured.

Thereafter, a development device was taken outside an apparatus and left under an environment of 40° C. and 90% RH for 72 hours, followed by again installing the development device into an image forming apparatus, further followed by measuring the charge amount Q/M per unit mass on the photosensitive member.

With Q/M on the photosensitive member at the time of image evaluation after 10,000 (10 k) sheets reproduction test assigned to 100%, a maintenance rate of Q/M on the photosensitive member after leaving for 72 hours was calculated and determined based on the following criteria.

In addition, evaluation C or above satisfies a practical level in the present invention.

A: The maintenance rate of Q/M on the photosensitive member is 90% or more.

B: The maintenance rate of Q/M on the photosensitive member is from 80% or more to less than 90%.

C: The maintenance rate of Q/M on the photosensitive member is from 70% or more to less than 80%.

D: The maintenance rate of Q/M on the photosensitive member is from 60% or more to less than 70%.

E: The maintenance rate of Q/M on the photosensitive member is less than 60%.

Examples 2 to 16

Magnetic carriers were prepared in a manner similar to Example 1 except that the conditions were changed to the conditions shown in Table 2. As the result that the power of a driver 8 was controlled so as to be constant at 3.5 kW, a peripheral speed of the stirring member became a value shown in Table 2.

The resulting magnetic carriers were subjected to evaluation similar to Example 1 and the results thereof are shown in Table 3.

Example 17

In the apparatus used in Example 1, an overlapping width C of the stirring member 3*a* and the stirring member 3*b* was set to 4.3 mm and $C/D_{3a}$ and $C/D_{3b}$ were set to 0.17.

With the above-mentioned apparatus configuration, the coating was conducted by adding 0.5 parts by mass of resin composition particles 1 as a first input amount (input amount E) to 100.0 parts by mass of magnetic carrier core a. During the coating, a processing time was set to 10 minutes and a peripheral speed of the outermost end of the stirring member 3 was adjusted to 11 m/sec. The coating conditions are shown in Table 2.

After the processing time passed and the rotor 2 stopped rotating, in a state where the material to be processed was in the body casing 1, a raw material inlet 5 was opened, 1.5 parts by mass of the resin composition particles 1 were added as a second input amount (input amount F), followed by coating under the same operation conditions as the above.

The resulting magnetic carrier was subjected to magnetic concentration and a circular vibration sifter equipped with a screen having a diameter of 500 mm and an aperture of 75 μm was used to separate coarse particles, thereby a magnetic carrier was obtained.

The resulting magnetic carrier had an average circularity of 0.977 and the proportion of magnetic carrier having a circularity of 0.900 or less was 0.1% by number. The residual resin composition particles in the magnetic carriers was in an amount of 0.2% by volume.

Examples 18 to 20

Magnetic carriers were prepared in a manner similar to Example 17 except that the conditions were changed to the conditions shown in Table 2.

The resulting magnetic carriers were evaluated in a manner similar to Example 1 and results thereof are shown in Table 3.

Examples 21 to 23

Magnetic carriers were prepared in a manner similar to Example 17 except that the magnetic carrier core a was changed to magnetic carrier cores b, c and d and furthermore the conditions were changed to the conditions shown in Table 2.

The resulting magnetic carriers were evaluated in a manner similar to Example 1 and results thereof are shown in Table 3.

Examples 24 and 25

Magnetic carriers were prepared in a manner similar to Example 17 except that the resin composition particles 1 were changed to resin composition particles 10, 11 and furthermore conditions were changed to conditions shown in Table 2.

The resulting magnetic carriers were evaluated in a manner similar to Example 1 and results thereof are shown in Table 3.

Comparative Example 1

In the present Comparative Example, as a coating apparatus, a high-speed stirring mixer (trade name: HIGH-FLEX-GRAL LFS-GS-2J, manufactured by Fukae Powtec Co., Ltd.) was used for coating.

As a coating condition, 1.5 parts by mass of the resin composition particles 1 were added to 100.0 parts by mass of the magnetic carrier core particles.

Then, after a material to be processed was input, oil was flowed as a heat medium to a jacket disposed outside of a body casing of the high-speed stirring mixer for heating so that the inside of the body casing may be 108° C., followed by stirring for 10 minutes at the peripheral speed of the outermost end of the stirring member of 11 m/sec.

The resulting magnetic carriers were subjected to magnetic concentration and a circular vibration sifter equipped with a screen having a diameter of 500 mm and an aperture of 75 μm was used to separate coarse particles, thereby a magnetic carrier was obtained.

The resulting magnetic carrier had an average circularity of 0.941 and the proportion of magnetic carriers having a circularity of 0.900 or less was 18.8% by number. The residual resin composition particles in the magnetic carriers was in an amount of 14.3% by volume. The resulting carrier was evaluated in a manner similar to Example 1. Evaluation results are shown in Table 3.

Comparative Examples 2 to 4

Magnetic carriers were prepared in a manner similar to Example 1 except that the conditions were changed to the conditions shown in Table 2. As the result that the power of the driver 8 was controlled so as to be constant at 3.5 kW, a peripheral speed of the stirring member became a value described in Table 2.

The resulting magnetic carriers were subjected to evaluation similar to Example 1 and the results thereof are shown in Table 3.

TABLE 2

| | Resin composition particles | Magnetic core particles | Coated amount (parts by mass) | Coating time (min) | Peripheral speed of the outermost end of stirring member (m/s) | Temperature of a material to be processed (° C.) | A ($\times 10^{-4}$ m$^3$) | B ($\times 10^{-4}$ m$^3$) | A/B | C (mm) | D (mm) | C/D |
|---|---|---|---|---|---|---|---|---|---|---|---|---|
| Example 1 | 1 | a | 1.5 | 10 | 11 | 58 | 5.7 | 2.7 | 2.1 | 4.3 | 25.0 | 0.17 |
| Example 2 | 1 | a | 1.5 | 10 | 7 | 66 | 5.7 | 2.7 | 2.1 | 12.5 | 25.0 | 0.50 |
| Example 3 | 1 | a | 1.5 | 10 | 19 | 42 | 5.7 | 2.7 | 2.1 | 1.3 | 25.0 | 0.05 |
| Example 4 | 2 | a | 1.5 | 10 | 11 | 58 | 5.7 | 2.7 | 2.1 | 4.3 | 25.0 | 0.17 |
| Example 5 | 3 | a | 1.5 | 10 | 11 | 58 | 5.7 | 2.7 | 2.1 | 4.3 | 25.0 | 0.17 |
| Example 6 | 4 | a | 1.5 | 10 | 11 | 58 | 5.7 | 2.7 | 2.1 | 4.3 | 25.0 | 0.17 |
| Example 7 | 7 | a | 1.5 | 10 | 11 | 56 | 5.7 | 2.7 | 2.1 | 4.3 | 25.0 | 0.17 |
| Example 8 | 8 | a | 1.5 | 10 | 11 | 56 | 5.7 | 2.7 | 2.1 | 4.3 | 25.0 | 0.17 |
| Example 9 | 1 | a | 1.5 | 10 | 7 | 58 | 5.7 | 2.7 | 2.1 | 15.0 | 25.0 | 0.60 |
| Example 10 | 1 | a | 1.5 | 10 | 19 | 57 | 5.7 | 2.7 | 2.1 | 1.0 | 25.0 | 0.04 |
| Example 11 | 1 | a | 1.5 | 10 | 19 | 59 | 3.0 | 2.7 | 1.1 | 1.0 | 25.0 | 0.04 |
| Example 12 | 1 | a | 1.5 | 10 | 7 | 57 | 10.8 | 2.7 | 4.0 | 1.0 | 25.0 | 0.04 |
| Example 13 | 1 | a | 1.5 | 10 | 7 | 57 | 11.3 | 2.7 | 4.2 | 1.0 | 25.0 | 0.04 |
| Example 14 | 1 | a | 1.5 | 10 | 19 | 56 | 2.4 | 2.7 | 0.9 | 1.0 | 25.0 | 0.04 |
| Example 15 | 4 | a | 1.5 | 10 | 19 | 58 | 2.4 | 2.7 | 0.9 | 1.0 | 25.0 | 0.04 |
| Example 16 | 8 | a | 1.5 | 10 | 19 | 56 | 2.4 | 2.7 | 0.9 | 1.0 | 25.0 | 0.04 |
| Example 17 | 4 | a | 0.5/1.5 | 10/10 | 11 | 58 | 5.7 | 2.7 | 2.1 | 4.3 | 25.0 | 0.17 |
| Example 18 | 4 | a | 0.9/1.1 | 10/10 | 11 | 57 | 5.7 | 2.7 | 2.1 | 4.3 | 25.0 | 0.17 |
| Example 19 | 4 | a | 1.5/0.5 | 10/10 | 11 | 58 | 5.7 | 2.7 | 2.1 | 4.3 | 25.0 | 0.17 |
| Example 20 | 1 | a | 0.5/0.5 | 10/10 | 11 | 58 | 5.7 | 2.7 | 2.1 | 4.3 | 25.0 | 0.17 |
| Example 21 | 1 | b | 0.5/1.5 | 10/10 | 9 | 59 | 5.0 | 2.7 | 1.9 | 4.3 | 25.0 | 0.17 |
| Example 22 | 1 | c | 0.9/2.4 | 10/10 | 13 | 65 | 5.7 | 2.7 | 2.1 | 4.30 | 25.0 | 0.17 |
| Example 23 | 1 | d | 0.5/1.2 | 10/10 | 9 | 57 | 5.7 | 2.7 | 2.1 | 4.30 | 25.0 | 0.17 |
| Example 24 | 10 | a | 0.5/1.5 | 10/10 | 18 | 85 | 5.7 | 2.7 | 2.1 | 4.30 | 25.0 | 0.17 |
| Example 25 | 11 | a | 0.5/1.5 | 10/10 | 18 | 92 | 5.7 | 2.7 | 2.1 | 4.30 | 25.0 | 0.17 |
| Comparative Example 1 | 1 | a | 1.5 | 10 | 11 | 108 | — | — | — | — | — | — |
| Comparative Example 2 | 5 | a | 1.5 | 10 | 19 | 60 | 2.4 | 2.7 | 0.9 | 1.0 | 25.0 | 0.04 |

TABLE 2-continued

| | Resin composition particles | Magnetic core particles | Coated amount (parts by mass) | Coating time (min) | Peripheral speed of the outermost end of stirring member (m/s) | Temperature of a material to be processed (° C.) | A ($\times 10^{-4}$ m$^3$) | B ($\times 10^{-4}$ m$^3$) | A/B | C (mm) | D (mm) | C/D |
|---|---|---|---|---|---|---|---|---|---|---|---|---|
| Comparative Example 3 | 6 | a | 1.5 | 10 | 19 | 58 | 2.4 | 2.7 | 0.9 | 1.0 | 25.0 | 0.04 |
| Comparative Example 4 | 9 | a | 1.5 | 10 | 19 | 55 | 2.4 | 2.7 | 0.9 | 1.0 | 25.0 | 0.04 |

TABLE 3

| | D50 (μm) | Average circularity | Proportion of particles having a circularity of 0.900 or less (% by number) | Residual resin composition particles (% by volume) | Surface state of magnetic carrier | Initial charge potential (V) | Rate of variation of develop-ability | Rate of variation of image density | Q/M maintain-ability on a photosensi-tive member | Leakage | Q/M maintain-ability after leaving |
|---|---|---|---|---|---|---|---|---|---|---|---|
| Example 1 | 37.9 | 0.975 | 0.2 | 0.5 | A | A (530 V) | B (93%) | A (98%) | A (95%) | A | A (95%) |
| Example 2 | 37.8 | 0.972 | 0.2 | 0.7 | A | A (540 V) | B (87%) | A (95%) | B (88%) | A | B (87%) |
| Example 3 | 37.5 | 0.970 | 0.8 | 0.7 | B | A (540 V) | B (85%) | A (95%) | B (86%) | B | B (85%) |
| Example 4 | 37.8 | 0.974 | 0.2 | 0.7 | A | A (540 V) | B (89%) | A (98%) | A (93%) | A | A (92%) |
| Example 5 | 37.7 | 0.972 | 0.2 | 0.7 | A | A (540 V) | B (88%) | A (97%) | A (91%) | A | A (90%) |
| Example 6 | 37.6 | 0.970 | 0.4 | 0.9 | A | A (540 V) | B (89%) | B (93%) | A (98%) | A | B (87%) |
| Example 7 | 37.8 | 0.976 | 0.1 | 0.0 | A | B (580 V) | B (87%) | A (98%) | B (88%) | A | A (95%) |
| Example 8 | 37.8 | 0.976 | 0.1 | 0.0 | A | B (550 V) | B (89%) | A (98%) | A (95%) | A | A (95%) |
| Example 9 | 37.7 | 0.972 | 0.4 | 0.8 | B | B (580 V) | B (85%) | A (97%) | B (83%) | B | B (82%) |
| Example 10 | 37.6 | 0.970 | 0.8 | 0.8 | B | B (550 V) | B (87%) | A (96%) | C (75%) | A | B (80%) |
| Example 11 | 37.6 | 0.970 | 1.0 | 0.9 | B | B (560 V) | C (84%) | A (96%) | C (73%) | A | B (78%) |
| Example 12 | 37.7 | 0.971 | 0.2 | 1.2 | B | B (560 V) | C (81%) | A (95%) | C (71%) | B | C (70%) |
| Example 13 | 37.8 | 0.971 | 0.2 | 1.3 | B | B (560 V) | C (80%) | A (95%) | C (70%) | B | C (70%) |
| Example 14 | 37.6 | 0.970 | 1.1 | 0.8 | C | B (580 V) | C (77%) | B (87%) | B (81%) | C | C (70%) |
| Example 15 | 37.6 | 0.970 | 1.2 | 1.0 | C | B (580 V) | C (80%) | B (84%) | B (84%) | C | B (81%) |
| Example 16 | 37.7 | 0.971 | 1.2 | 0.3 | C | B (570 V) | C (82%) | B (87%) | B (81%) | C | B (83%) |
| Example 17 | 38.0 | 0.977 | 0.1 | 0.2 | A | A (520 V) | A (96%) | A (98%) | A (96%) | A | A (97%) |
| Example 18 | 37.9 | 0.974 | 0.2 | 0.4 | B | A (530 V) | A (95%) | A (97%) | A (94%) | A | A (95%) |
| Example 19 | 37.9 | 0.972 | 0.3 | 0.5 | B | A (540 V) | A (95%) | A (95%) | A (93%) | A | A (91%) |
| Example 20 | 38.1 | 0.979 | 0.0 | 0.0 | A | A (520 V) | A (97%) | A (98%) | A (98%) | A | A (98%) |
| Example 21 | 44.0 | 0.953 | 2.1 | 0.1 | A | A (520 V) | B (91%) | B (89%) | A (90%) | A | A (90%) |
| Example 22 | 27.3 | 0.970 | 2.3 | 0.3 | A | A (540 V) | B (91%) | A (95%) | A (90%) | A | A (91%) |
| Example 23 | 58.9 | 0.960 | 1.5 | 0.5 | A | A (520 V) | A (95%) | B (87%) | B (86%) | A | B (85%) |
| Example 24 | 37.8 | 0.975 | 0.1 | 0.3 | A | A (540 V) | A (93%) | A (96%) | A (94%) | A | A (95%) |
| Example 25 | 37.9 | 0.976 | 0.2 | 0.5 | A | A (510 V) | A (97%) | A (98%) | A (97%) | A | A (97%) |
| Comparative Example 1 | 33.8 | 0.941 | 18.8 | 14.3 | D | B (570 V) | D (70%) | C (75%) | D (62%) | D | D (68%) |
| Comparative Example 2 | 37.6 | 0.964 | 2.3 | 3.3 | C | B (590 V) | D (72%) | C (80%) | C (71%) | C | C (70%) |
| Comparative Example 3 | 37.6 | 0.966 | 1.8 | 2.8 | B | C (620 V) | D (73%) | C (84%) | C (74%) | B | C (73%) |
| Comparative Example 4 | 37.5 | 0.968 | 1.4 | 4.4 | C | B (590 V) | D (74%) | C (84%) | C (79%) | C | C (70%) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2009-146230 applied on Jun. 19, 2009 and Japanese Patent Application No. 2009-146235 applied on Jun. 19, 2009, the disclosure of which is incorporated herein by reference.

What is claimed is:

1. A method for producing a magnetic carrier, comprising coating a surface of magnetic carrier core particles with resin composition particles by a mechanical impact force to produce a magnetic carrier coated with a resin composition, wherein the coating is conducted by the use of a coating apparatus comprising a rotor having at least a plurality of stirring members on a surface thereof, a driver for driving the rotor by rotation, and a body casing disposed with a gap from the stirring members;

the resin composition particles has a 50% particle diameter (D50) based on volume of from 0.2 μm or more to 6.0 μm or less and the proportion of particles of 10.0 μm or more is 2.0% by volume or less; and the magnetic carrier core particles and the resin composition particles input in the coating apparatus are, by rotating the rotor, transported by a part of the stirring members in a direction of the driver which is one direction of an axial direction of the rotor and transported by another other part of the stirring members in an anti-driver direction which is a direction reverse to the axial direction of the rotor, followed by, while repeatedly conducting the transportation in the driver direction and the transportation in the anti-driver direction, coating the surface of the magnetic carrier core particles with the resin composition particles.

2. The method for producing a magnetic carrier according to claim 1, wherein when the total volume of the magnetic carrier core particles and the resin composition particles input in the coating apparatus is taken as A, a minimum gap between an inner peripheral surface of the body casing and the stirring member is taken as d, and the volume of a cylindrical space having a thickness d toward a center direction from the inner peripheral surface of the body casing is taken as B, the A and the B satisfy a relationship represented by the following formula:

$$1.1 \leqq A/B \leqq 4.0.$$

3. The method for producing magnetic carrier according to claim 1, wherein as to an arbitrary first stirring member and a second stirring member adjacent to the first stirring member on a downstream side in a direction of rotation, when the rotor is rotated, a trajectory of the first stirring member and a trajectory of the second stirring member overlap, when an overlapping width of the trajectories is taken as C, and maximum widths of the first and second stirring members are taken as $D_1$ and $D_2$ respectively, the overlapping width C and the maximum widths D of the first and second stirring members satisfy a relationship represented by the following formulas:

$$0.05 \leqq C/D_1 \leqq 0.50 \text{ and}$$

$$0.05 \leqq C/D_2 \leqq 0.50.$$

* * * * *